US005477252A

United States Patent [19]

Hasegawa et al.

[11] Patent Number: 5,477,252

[45] Date of Patent: Dec. 19, 1995

[54] SUBSTRATE FOR INK JET HEAD, INK JET HEAD PROVIDED WITH SAID SUBSTRATE AND INK JET APPARATUS HAVING SUCH INK JET HEAD

[75] Inventors: Kenji Hasegawa; Isao Kimura, both of Kawasaki; Atsushi Shiozaki, Nagahama; Koichi Touma, Tachikawa, all of Japan

[73] Assignee: Canon Kabushiki Kaisha, Tokyo, Japan

[21] Appl. No.: 971,837

[22] PCT Filed: Jul. 31, 1992

[86] PCT No.: PCT/JP92/00968

§ 371 Date: Apr. 29, 1993

§ 102(e) Date: Apr. 29, 1993

[87] PCT Pub. No.: WO93/02864

PCT Pub. Date: Feb. 18, 1993

[30] Foreign Application Priority Data

| | | | |
|---|---|---|---|
| Aug. 2, 1991 | [JP] | Japan | 3-194029 |
| Aug. 2, 1991 | [JP] | Japan | 3-194030 |
| Aug. 2, 1991 | [JP] | Japan | 3-194031 |
| Aug. 2, 1991 | [JP] | Japan | 3-194032 |
| Aug. 2, 1991 | [JP] | Japan | 3-194034 |
| Aug. 2, 1991 | [JP] | Japan | 3-194035 |
| Aug. 2, 1991 | [JP] | Japan | 3-194036 |
| Aug. 2, 1991 | [JP] | Japan | 3-194037 |

[51] Int. Cl.[6] ..... B41J 2/05

[52] U.S. Cl. ..... 347/62; 338/308; 347/204; 252/514

[58] Field of Search ..... 346/140; 252/514, 252/512; 338/308, 309; 347/62, 204

[56] References Cited

U.S. PATENT DOCUMENTS

| | | | |
|---|---|---|---|
| 3,763,026 | 10/1973 | Cordes | 252/514 X |
| 3,876,560 | 4/1975 | Kuo | 252/514 |
| 5,142,308 | 8/1992 | Hasegawa | 347/62 |
| 5,148,191 | 9/1992 | Hasegawa | 347/62 |

FOREIGN PATENT DOCUMENTS

| | | | |
|---|---|---|---|
| 135169 | 8/1984 | Japan | B41J 3/04 |
| 59-135169 | 8/1984 | Japan | B41J 3/04 |

*Primary Examiner*—Joseph W. Hartary

*Attorney, Agent, or Firm*—Fitzpatrick, Cella, Harper & Scinto

[57] ABSTRACT

There is provided an ink jet head which includes an electrothermal converting body disposed along a pathway of ink, said electrothermal converting body being provided with a heat generating resistor capable of generating, upon energization, heat energy to be directly applied to ink on a heat acting face whereby discharging said ink, characterized in that said heat generating resistor is composed of a material containing at least Ir and other one specific element at the specific respective composition rates or a material containing at least Ir and other two specific elements at the specific respective composition rates, said heat generating resistor constituted by any of said materials being capable of exhibiting a sufficient durability even in the case of driving the ink jet head with a relatively long drive pulse duration.

33 Claims, 12 Drawing Sheets

SUBSTRATE FOR INK JET HEAD, INK JET HEAD PROVIDED WITH SAID SUBSTRATE AND INK JET APPARATUS HAVING SUCH INK JET HEAD

FIELD OF THE INVENTION

The present invention relates to an ink jet head, a substrate for ink jet head capable of constituting said ink jet head and an ink jet apparatus which include an electrothermal converting body which excels in resistance to shock by cavitation, resistance to erosion by cavitation, chemical stability, electrochemical stability, oxidation resisting property, dissolution resisting property, heat resisting property, thermal shock resisting property, mechanical durability and so forth.

A representative one of such ink jet heads includes an electrothermal converting body having a heat generating resistor capable of generating, when energized, heat energy which is to be directly applied to ink on a heat acting face to cause the ink to be discharged. Such electrothermal converting body is low in power consumption and excels in responsibility to a signal inputted.

BACKGROUND OF THE INVENTION

An ink jet system utilizing heat energy disclosed in U.S. Pat. Nos. 4,723,129, 4,740,796, etc. can provide high speed, high density and high definition recording of a high quality and is suitable for color recording and also for compact designing. Accordingly, progressively increasing attention has been paid to such ink jet system in recent years. In a representative one of apparatus which employ such system, ink as the recording liquid is discharged utilizing heat energy, and accordingly, it has a heat acting portion which causes heat to act upon the ink. In particular, a heat generating resistor is provided for an ink pathway, and making use of heat energy generated from the heat generating resistor, ink is heated suddenly to produce an air bubble by which the ink is discharged.

The heat acting portion, in view of causing heat to act upon an object, a portion apparently similar in construction to a conventional so-called thermal head. However, the heat acting portion is quite different in fundamental technology from the thermal head in such portions that it contacts directly with ink, that it is subjected to mechanical shock which is caused by cavitations produced by repetitions of production and extinction of bubbles of ink, or in some cases, further to erosion, that it is subjected to a rise and a drop of temperature over almost 1,000° C. for a very short period of time of the order of $10^{-1}$ to 10 microseconds, and so forth. Accordingly, the thermal head technology cannot naturally be applied to the ink jet technology as it is. In other words, the thermal head technology and the ink jet technology cannot be discussed on the same level.

Incidentally, as for the heat acting portion of an ink jet head, since it is subjected to such severe environment as above described, it is a common practice to employ such a structure that an electric insulating layer made of, for example, $SiO_2$, SiC, $Si_3N_4$ or the like is disposed as a protective film on a heat generating resistor and a cavitation resisting layer made of Ta or the like is disposed thereon in order to protect the heat acting portion from environment in which it is used. As the constituent material of such protective layer for use with an ink jet head, such materials which are tough against a shock and erosion by a cavitation as described, for example, in U.S. Pat. No. 4,335,389 can be mentioned.

Apart from this, it is desired for the heat acting portion of an ink jet head to be designed such that heat generated from the heat generating resistor acts upon ink as efficiently and quickly as possible in order to save power consumption and improve the responsibility to a signal inputted. For this, other than the above-mentioned configuration in which the protective layer is provided, a configuration in which a heat generating resistor is disposed so as to directly contact with ink has been proposed by Japanese Patent Laid-open No. 126462/1980.

The ink jet head of this configuration is superior to the configuration in which the protective layer is provided with regard to thermal efficiency. However in this case, the heat generating resistor is subjected to a shock and erosion by cavitation and further to a rise and drop of temperature and in addition, to an electrochemical reaction which is caused by electric current which flows through recording liquid because the recording liquid contacts with heat generating resistor and has a conductivity. There are known various metals, alloys and metallic compounds, and cermets, beginning with $Ta_2N$ and $RuO_2$, as the constituent materials of heat generating resistors. However these are not always satisfactory in durability and stability when they are used as the constituent material of the heat generating resistor of the ink jet head of this configuration.

Some of ink jet heads of the configuration in which a protective layer is disposed as above described which have been proposed can be adopted in practical use in view of durability and resistance variation. However, it is very difficult, in any case, to perfectly prevent occurrence of defects which may take place at the time of forming the protective layer. This is a serious factor of reducing the yield in mass production. In recent years, there has been an increased demand for a further improvement in speed and density in recording. There is a tendency that the number of discharging outlets of an ink jet head is increased in order to cope with such demand. In this case, the above situation entails a serious problem.

Further, while the foregoing protective layer decreases the efficiency in transfer of heat from the heat generating resistor to the recording liquid, if the transfer efficiency is low, the entire power consumption required increases and a variation in temperature in the ink jet head upon driving increases. Such temperature variation results in causing a variation in volume of a liquid droplet discharged from a discharging outlet, which causes a variation in density of an image recorded. Meanwhile, if the number of discharging operations per unit time is increased in order to cope with an increase in recording speed, the power consumption by the ink jet head is heightened accordingly and as a result, the temperature variation is increased. Such temperature variation will bring about a corresponding density variation of an image obtained. Other than this, in the case of making an increase in the number of discharging outlets which involves an increase in density of electrothermal converting bodies, the power consumption by the ink jet head is heightened and as a result, the temperature variation is increased, resulting in making the resulting record images to have a variation in density corresponding such temperature variation. These problems of making the resulting record images to be varied in density are contrary to the demand for providing a high quality record image, and they are required to be solved as early as possible.

In order to solve these problems, early provision of an improved ink jet head of the configuration in which an heat generating resistor contacts directly with ink and which excels in the thermal efficiency is earnestly desired.

However, as already described in the above, in the conventional configuration in which ink contacts directly with the heat generating resistor, the heat generating resistor is subjected to expose to not only a shock or erosion by cavitation and further to a rise and drop of temperature but also to an electrochemical reaction. Because of this, the heat generating body constituted by a conventional material such as $Ta_2N$, $RuO_2$, $HfB_2$, or the like causes problems in durability such that it is mechanically destroyed, corroded or dissolved.

The materials which are disclosed in U.S. Pat. No. 4,335,389 as being tough against a shock or erosion by cavitation are understood to exhibit their effects for the first time when they are used as the constituent of such a protective layer (a cavitation resisting layer) as above described. However, in the case where any of these materials is employed for the heat generating resistor which contacts directly with ink, it is often dissolved or corroded by an electrochemical reaction, and because of this, a sufficient durability cannot be insured therefore.

In order to perform recording of a high definition and a high quality, stable ink discharging is essential. For this purpose, the heat generating resistor is necessary to be small in resistance variation. Incidentally, Ta or Ta-Al alloy described in Japanese Patent Laid-open No. 96971/1984 is comparatively superior, in the case where it is used as the constituent of the heat generating resistor of an ink jet head in which the heat generating resistor contacts directly with ink, in durability, particularly, in cavitation resisting property in that the heat generating resistor is not broken. However, in regard to a variation in resistance during the repetition of production of bubbles, any of Ta and Ta-Al alloy is not satisfactory in that the resistance variation is not small enough as desired. Further, any of Ta and Ta-Al alloy does not have a very high ratio M between an applied pulse voltage ($V_{break}$) at which the heat generating resistor is broken and a bubble producing threshold voltage ($V_{th}$) and does not have a very high heat resisting property. Consequently, they have a problem such that the lifetime of the heat generating resistor constituted by any of them is often greatly deteriorated even by a small increase in driving voltage ($V_{op}$). In particular, any of Ta and Ta-Al is not always sufficiently high in resisting property to an electrochemical reaction. Because of this, when any of them is used as the constituent of the heat generating body of an ink jet head in which the heat generating body contacts directly with ink, if production of bubbles is repeated by a number of pulses applied, the electric resistance of the heat generating resistor is varied to a great extent. Thus, there is a problem in that the state of producing bubbles is also varied depending upon such variation in the electric resistance of the heat generating resistor. In addition, there is also a problem in that a small variation in the $V_{op}$ causes a significant influence on the lifetime of the heat generating resistor since the heat resisting property is not high enough as desired.

Thus, it is understood that in the case where the heat generating resistor which contacts directly with recording liquid (that is, ink) is formed of any of the known materials, there cannot be readily obtain an ink jet head or an ink jet apparatus which satisfies all of resistance to shock by cavitation, resistance to erosion by cavitation, mechanical durability, chemical stability, electrochemical stability, inherent resistance stability, heat resistance, oxidation resistance, dissolution resistance and resistance to thermal shock. Particularly, there cannot be obtained an ink jet head having the configuration in which the heat generating body is disposed so as to directly contact with ink and which is high in heat transfer efficiency, superior in signal responsibility, and has a satisfactory durability and a satisfactory liquid discharging stability.

The present inventors previously had accomplished inventions capable of solving those technical problems as above described (see, International Publication WO90/09888 (hereinafter referred to as Literature 1) and International Publication WO90/09887 (hereinafter referred to as Literature 2)). Particularly, by Literatures 1 and 2, the present inventors proposed the use of a Ir-Ta alloy containing these elements respectively at a specific composition rate and a Ir-Ta-Al alloy containing these elements respectively at a specific composition rate as the constituent of the heat generating resistor of an ink let head. These alloys are ones which can satisfy, to a certain extent, all of resistance to shock by cavitation, resistance to erosion by cavitation, mechanical durability, chemical stability, electrochemical stability, inherent resistance stability, heat resistance, oxidation resistance, dissolution resistance and resistance to thermal shock. In these alloys, Ir is a material which is liable to exhibit superiority in terms of heat resistance, oxidation resistance and chemical stability.

Incidentally, in recent years, there is a tendency that the ink jet apparatus is miniaturized. In fact, a number of miniature ink jet apparatus having a secondary battery installed therein are commercially available.

By the way, commercially available ordinary second batteries are of a voltage of about 10 V. Ink jet apparatus having such secondary battery installed therein are usually used in such a way that a prescribed converter is installed and using this converter, the voltage of about 10 V of the secondary battery is raised to a doubled voltage of about 20 V. The reason for this is for attaining high speed recording at a high speed drive by shortening the drive pulse duration (the driving duration in other words).

As for these ink jet apparatus, there is an increased demand for further miniaturizing them. In order to cope with such demand, it is desired to eliminate the use of a converter. In the case of an ink jet apparatus with no converter, the situation comes to a result that a voltage of about 10 V of a second battery is used as the driving voltage, wherein the drive pulse duration (the driving duration) is necessary to be enlarged to an extent that ink can be discharged in a desired state, because the driving voltage is low. However, in the case of driving the ink jet apparatus with such relatively long drive pulse duration, any of the heat generating resistors described in Literatures 1 and 2 is not satisfactory especially in terms of durability. Consequently, there is a demand for early provision of a heat generating resistor which is sufficiently durable even in the case of driving the ink jet apparatus with a relatively long drive pulse duration.

SUMMARY OF THE INVENTION

It is a principal object of the present invention to eliminate the foregoing problems in the known ink jet heads and to provide an improved ink jet head.

Other object of the present invention is to provide an improved ink jet head which excels in any of resistance to shock by cavitation, resistance to erosion by cavitation, mechanical durability, chemical stability, electrochemical stability, inherent resistance stability, heat resistance, oxidation resistance, dissolution resistance and resistance to thermal shock.

A further object of the present invention is to provide an improved ink jet head in which heat energy is always stably transmitted at a high efficiency to recording liquid (ink) rapidly in response to a signal on demand to effect ink discharging whereby providing excellent recorded images, even after repetitive use over a long period of time.

A still further object of the present invention is to provide an improved ink jet head having a structure excelling in heat transfer wherein a heat generating resistor is disposed so as to directly contact with recording liquid and in which the power consumption by the heat generating resistor is restricted low to minimize the temperature variation of the ink jet head and, even after repetitive use over a long period of time, ink discharging is always stably effected to provide recorded images which are free of a variation in density caused by a variation in temperature of the ink jet head.

A yet further object of the present invention is to provide an ink jet head provided with a heat generating resistor constituted by a material with full advantage of the merits of Ir liable to exhibit superiority especially in terms of heat resistance, oxidation resistance and chemical stability which exhibits a sufficient durability, even in the case of driving the ink jet head with a relatively long drive pulse duration.

A further object of the present invention is to provide a substrate for ink jet head which constitutes the above ink jet head and an ink jet apparatus provided with the above ink jet head.

The present inventors have made extensive studies aiming at solving the foregoing problems in the known ink jet heads and attaining the above objects.

As a result, the present inventors have obtained findings that in the case where the heat generating resistor of an ink jet head is constituted by a non-single crystalline material comprising Ir and other one specific element or a non-single crystalline material comprising Ir and other two specific elements, the above objects can be attained. The present invention has been accomplished based on these findings.

These non-single crystalline materials include amorphous materials, polycrystalline materials, and materials respectively comprising amorphous material and polycrystalline material in a mixed state, respectively containing Ir and other one specific element at respective specific composition rates or containing Ir and other two specific elements at respective specific composition rates (these will be hereinafter referred to as "non-single crystalline material" or "alloy").

BRIEF DESCRIPTION OF THE DRAWINGS

PIG. 1(*a*) is a schematic front elevation view of an example of an ink jet head of the present invention as viewed from the discharging outlet side.

FIG. 2(*b*) is a schematic plan view of the substrate for ink jet head at a stage at which a protective layer is provided over those layers.

Figure 4A:
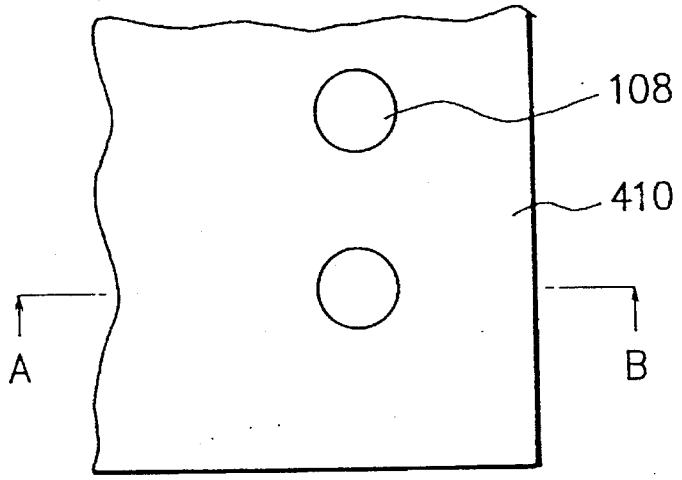
FIG. 4(*a*) is a schematic top plan view of a further example of an ink jet head of the present invention.

PIG. 4(*b*) is a schematic sectional view taken along the line A-B in FIG. 4(*a*).

Figure 5:
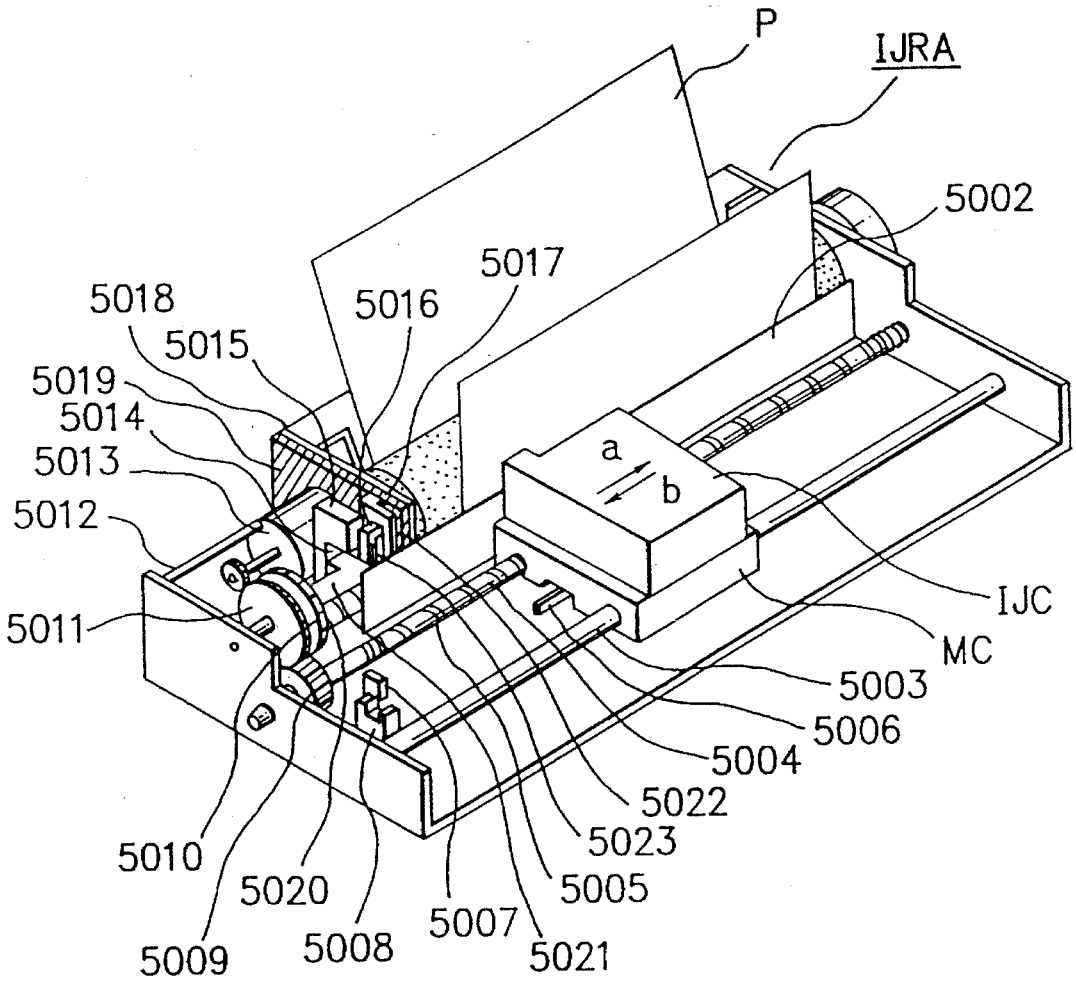

FIG. 5 is an appearance perspective view illustrating an example of an ink jet apparatus of the present invention.

Figure 6:
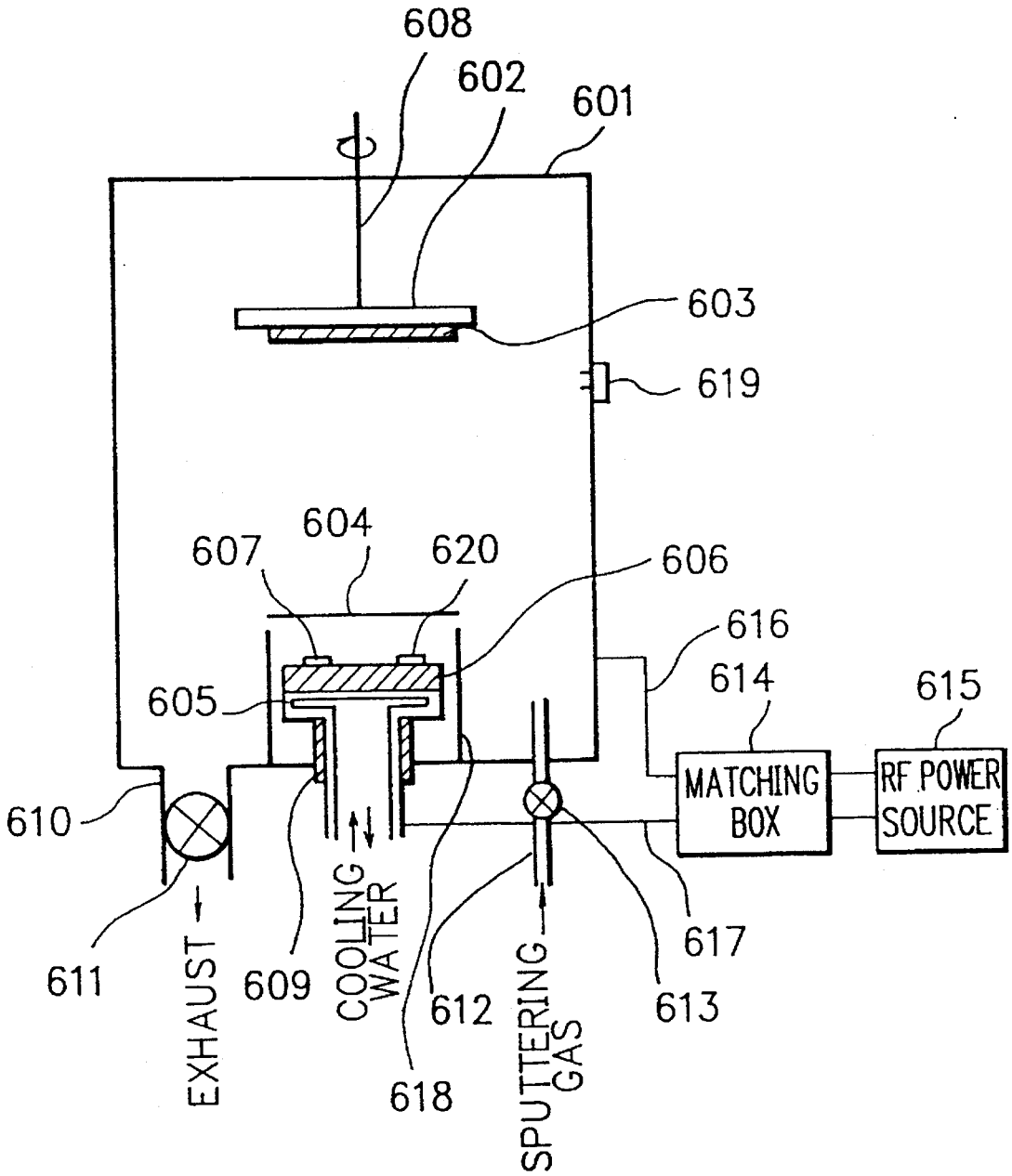

FIG. 6 is a schematic sectional view illustrating an example of a high frequency sputtering apparatus which is employed for forming a film for a heat generating resistor or the like in the present invention.

FIGS. 7 to 14 are views respectively showing the composition range for a material by which a heat generating resistor according to the present invention is constituted.

The present invention includes five embodiments which will be under described.

(Embodiment A)

An ink jet head provided with a heat generating resistor constituted by a non-single crystalline material in which the Ta of the Ir-Ta alloy described in LITERATURE 1 is replaced by other element, wherein the merits of Ir which is liable to exhibit superiority especially in terms of heat resistance, oxidation resistance and chemical stability are used.

(Embodiment B)

An ink jet head provided with a heat generating resistor constituted by a non-single crystalline material in which the Al of the Ir-Ta-Al alloy described in LITERATURE 2 is replaced by other element, wherein the merits of Ir which is liable to exhibit superiority especially in terms of heat resistance, oxidation resistance and chemical stability are used.

(Embodiment C)

An ink jet head provided with a heat generating resistor constituted by a non-single crystalline material in which the Ta of the Ir-Ta-Al alloy described in LITERATURE 2 is replaced by other element, wherein the merits of Ir which is liable to exhibit superiority especially in terms of heat resistance, oxidation resistance and chemical stability are used.

(Embodiment D)

An ink jet head provided with a heat generating resistor constituted by a non-single crystalline material in which the Ta and Al of the Ir-Ta-Al alloy described in LITERATURE 2 are replaced by other two elements, wherein the merits of Ir which is liable to exhibit superiority especially in terms of heat resistance, oxidation resistance and chemical stability are used.

(Embodiment E)

An ink jet head provided with a heat generating resistor constituted by a non-single crystalline material in which the Ir, which is liable to exhibit superiority especially in terms of heat resistance, oxidation resistance and chemical stability, of the Ir-Ta alloy described in LITERATURE 1 is replaced by platinum belonging to the same group to which the Ir pertains and the Ta is replaced by other element.

In more detail, each of the above embodiments A to E is of the content as will be under described.

(Embodiment A)

The heat generating body of the ink jet head is composed of a material containing Ir and Cr respectively at a specific composition rate, wherein the iridium (Ir) is selected in the viewpoints that it exhibits superiority in terms of heat resistance, oxidation resistance and chemical stability, and the chromium (Cr) is selected in the viewpoints that it exhibits a mechanical strength and provides an oxide which excels in resistance to dissolution in solvents.

(Embodiment B-a)

The heat generating body of the ink jet head is composed of a material containing Ir, Ta and Ti respectively at a specific composition rate, wherein the iridium (Ir) is selected in the viewpoints that it exhibits superiority in terms of heat resistance, oxidation resistance and chemical stability, the tantalum (Ta) is selected in the viewpoints that it provides a strength and an electrical resistance while affording an alloy when it is combined with other metal element, and the titanium (Ti) is selected in the viewpoints that it is superior in terms of workability and adhesion and provides an oxide which excels in resistance to dissolution in solvents.

(Embodiment B-b)

The heat generating body of the ink jet head is composed of a material containing Ir, Ta and Ru respectively at a specific composition rate, wherein the iridium (Ir) is selected in the viewpoints that it exhibits superiority in terms of heat resistance, oxidation resistance and chemical stability, the ruthenium (Ru) is selected in the view points that it is superior in terms of oxidation resistance and chemical stability and provides a strength while affording an alloy when it is combined with other metal element, and the tantalum (Ta) is selected in the viewpoints that it provides an oxide which excels in heat resistance and resistance to dissolution in solvents.

(Embodiment B-c)

The heat generating body of the ink jet head is composed of a material containing Ir, Ta and Os respectively at a specific composition rate, wherein the iridium (Ir) is selected in the viewpoints that it exhibits superiority in terms of heat resistance, oxidation resistance and chemical stability, the osmium (Os) is selected in the viewpoints that it is superior in terms of chemical stability and heat resistance and provides a strength and an electrical resistance while affording an alloy when it is combined with other metal element, and the tantalum (Ta) is selected in the viewpoints that it is superior in terms of mechanical strength and provides an oxide which excels in resistance to dissolution in solvents.

(Embodiment B-d)

The heat generating body of the ink jet head is composed of a material containing Ir, Ta and Re respectively at a specific composition rate, wherein the iridium (Ir) is selected in the viewpoints that it exhibits superiority in terms of heat resistance, oxidation resistance and chemical stability, the rhenium (Re) is selected in the viewpoints that it is superior in terms of heat resistance and provides a strength and an electrical resistance while affording an alloy when it is combined with other metal element, and the tantalum (Ta) is selected in the viewpoints that it is superior in terms of mechanical strength and provides an oxide which excels in resistance to dissolution in solvents.

(Embodiment C)

The heat generating body of the ink jet head is composed of a material containing Ir, Al and Y respectively at a specific composition rate, wherein the iridium (Ir) is selected in the viewpoints that it exhibits superiority in terms of heat resistance, oxidation resistance and chemical stability, the yttrium (Y) is selected in the viewpoints that it provides a strength and an electrical resistance while affording an alloy when it is combined with other metal element, and the aluminum (Al) is selected in the viewpoints that it is superior in terms of workability and adhesion and provides an oxide which excels in resistance to dissolution in solvents.

(Embodiment D)

The heat generating body of the ink jet head is composed of a material containing Ir, Ru and Cr respectively at a specific composition rate, wherein the iridium (Ir) is selected in the viewpoints that it exhibits superiority in terms of heat resistance, oxidation resistance and chemical stability, the ruthenium (Ru) is selected in the view points that it is superior in terms of oxidation resistance and chemical stability and provides a strength while affording an alloy when it is combined with other metal element, and the chromium (Cr) is selected in the viewpoints that it provides an oxide which excels in heat resistance and resistance to dissolution in solvents.

(Embodiment E)

The heat generating body of the ink jet head is composed of a material containing Pt and Ta respectively at a specific composition rate, wherein the platinum (Pt) is selected in the viewpoints that it is superior in terms of heat resistance, oxidation resistance and chemical stability, and the tantalum (Ta) is selected in the viewpoints that it is superior in terms of mechanical strength and provides an oxide which excels in resistance to dissolution in solvents.

The present invention that includes the above-described embodiments A to E has been accomplished based on the findings obtained as a result of the experiments conducted by the present inventors, which will be hereinafter described.

The present inventors prepared a plurality of nonsingle crystalline material samples in accordance with each of the above embodiments by means of the sputtering technique. The individual samples were prepared by forming a film on each of a Si-single crystal base member and a Si-single crystal base member with a thermally oxidized $SiO_2$ film of 2.5 μm in thickness formed on a surface thereof, using a sputtering apparatus (trademark name: Sputtering Apparatus CFS-8EP, product by Kabushiki Kaisha Tokuda Seisakusho) shown in FIG. 6.

The sputtering apparatus shown in FIG. 6 has a film-forming chamber 601. The film-forming chamber 601 is provided with a substrate holder 602 capable of holding a substrate 603 on which a film is to be formed. The substrate holder 602 has a heater (not shown) built therein which serves to heat the substrate 603. The substrate holder 602 is supported by means of a rotary shaft 608 extending from a driving motor (not shown) disposed outside the system so that it can be moved up and down while being rotated.

At a position in the film-forming chamber 601 opposing to the substrate 603, there is arranged a target holder 605 for holding thereon a target for the formation of a film.

Reference numeral 606 indicates a target disposed on the surface of the target holder 605, which comprises a plate composed of a given element of higher than 99.9 weight percent in purity. On the target 606, there are arranged other target 607 and a further target 620, each of which comprising a sheet composed of a given element of 99.9 weight percent or more in purity. As shown in the figure, the target 607 and the target 620 each having a predetermined area are disposed spacedly, individually by a plural number in a predetermined relationship on the surface of the target 606. The areas and positions of the individual targets 607 and targets 620 are determined in accordance with the analytical curves obtained in advance based on the results of ascertainment studies which have been made of how a film containing desired elements at respective predetermined composition rates can be obtained from the relationship of an area ratio of the targets.

Reference numeral 618 indicates a protective wall which is disposed so as to cover over the side face of the target holder 605, wherein the protective wall serves to cover over the targets 606, 607 and 620 so that they are not sputtered by plasma from the side faces thereof. Reference numeral 615 indicates a RF power source which is electrically connected through a matching box 614 and a conductor 616 to the circumferential wall of the film-forming chamber 601 and which is also electrically connected to the target holder 605 through the matching box 614 and a conductor 617.

The target holder 605 is provided with a mechanism (not shown) capable of circulating cooling water therein so that the targets 606, 607 and 620 may be maintained at a predetermined temperature during film formation. The film-forming chamber 601 is provided with an exhaust pipe 610 which serves to evacuate the inside of the film-forming chamber 601 therethrough. The exhaust pipe 610 is connected through an exhaust valve 611 to a vacuum pump (not shown).

Reference numeral 612 indicates a gas supply pipe which serves to introduce sputtering gas such as argon gas (Ar gas), neon gas (Ne gas) or the like into the film-forming chamber 601. The gas supply pipe 612 is provided with a gas flow regulating valve 613 which serves to regulate the flow rate of the sputtering gas to be introduced. Reference numeral 609 indicates an insulator interposed between the target holder 605 and the bottom wall of the film-forming chamber 601, which serves to electrically isolate the target holder 605 from the film-forming chamber 601. The film-forming chamber 601 is provided with a vacuum gage 619 which serves to detect the inner pressure of the film-forming chamber 601. The condition upon the sputtering is adjusted in accordance with a pressure detected by the vacuum gage 619.

Reference numeral 604 indicates a shutter plate which is disposed such that it can horizontally move at a position above the target holder 605 so as to cut off the space between the substrate 603 and the targets 606, 607 and 620. The shutter plate 604 is used in the following manner. That is, before starting film formation, the shutter plate 604 is moved to a position above the target holder 605 having the targets 606, 607 and 620 thereon, and inert gas such as argon gas (Ar) or the like is introduced into the film-forming chamber 601 through the gas supply pipe 612. Then, a RF power from the RF power source 615 is applied to produce plasma of the inert gas, wherein the targets 606, 607 and 620 are sputtered by the plasma produced to remove foreign matters from the surfaces of the targets. Thereafter, the shutter plate 604 is moved to other position (not shown) where it does not interfere film formation.

As the respective targets, there were used targets respectively comprising a specific element depending upon the kind of a heat generating resistor to be obtained.

In Embodiment A:

606: Cr, 607: Ir, 620: Ir

In Embodiment B-a:

606: Ti, 607: Ir, 620: Ta

In Embodiment B-b:

606: Ta, 607: Ir, 620: Ru

In Embodiment B-c:

606: Ta, 607: Ir, 620: Os

In Embodiment B-d:

606: Ta, 607: Ir, 620: Re

In Embodiment C:

606: Al, 607: Ir, 620: Y

In Embodiment D:

606: Cr, 607: Ir, 620: Ru

In Embodiment E:

606: Ta, 607: Pt, 620: Pt

Each sample was prepared under the following film-forming conditions using the apparatus shown in FIG. 6 which was described in the above.

Substrates placed on the substrate holder 602:

Si single crystal substrate of 4 inch in size (manufactured by Wacker Company), and Si single crystalline substrate of 4 inch in size, having a 2.5 μm thick $SiO_2$ film thereon (manufactured by Wacker Company)

Substrate temperature: 50° C.

Base pressure: $2.6\times10^{-4}$ Pa or less

High frequency (RF) power applied: 1000 W

Sputtering gas and gas pressure: argon gas, 0.4 Pa

Film forming period: 12 minutes

Of the individual samples obtained in such a manner as above described, some of them which were prepared each by forming a film on the $SiO_2$ film of substrate were subjected to electron probe microanalysis using a EPM-810 manufactured by Kabushiki Kaisha Shimazu Seisakusho, to thereby perform composition analysis. And those samples which were prepared each by forming a film on the Si single crystalline substrate were examined with respect to crystallinity by means of a X-ray diffraction meter produced by Mac Science Company (commercially available name: MXP 3). The results obtained in each case are shown in the following figures.

Figure 13:
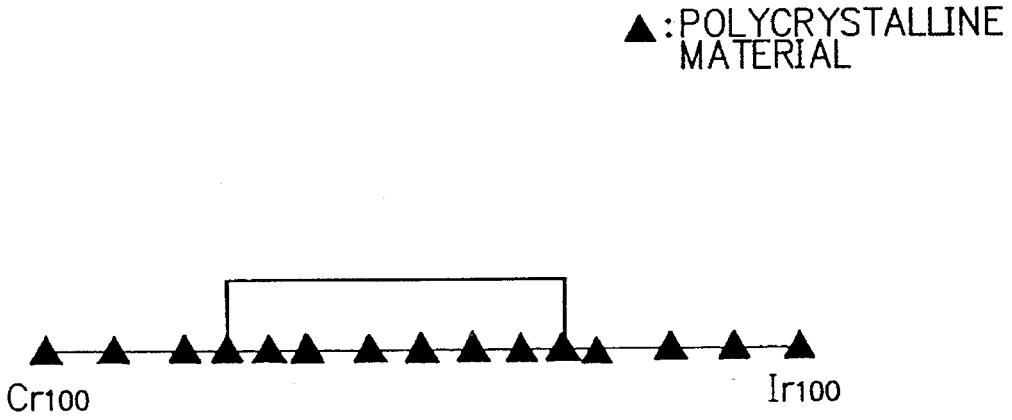

The results for Embodiment A: FIG. 13

Figure 7:
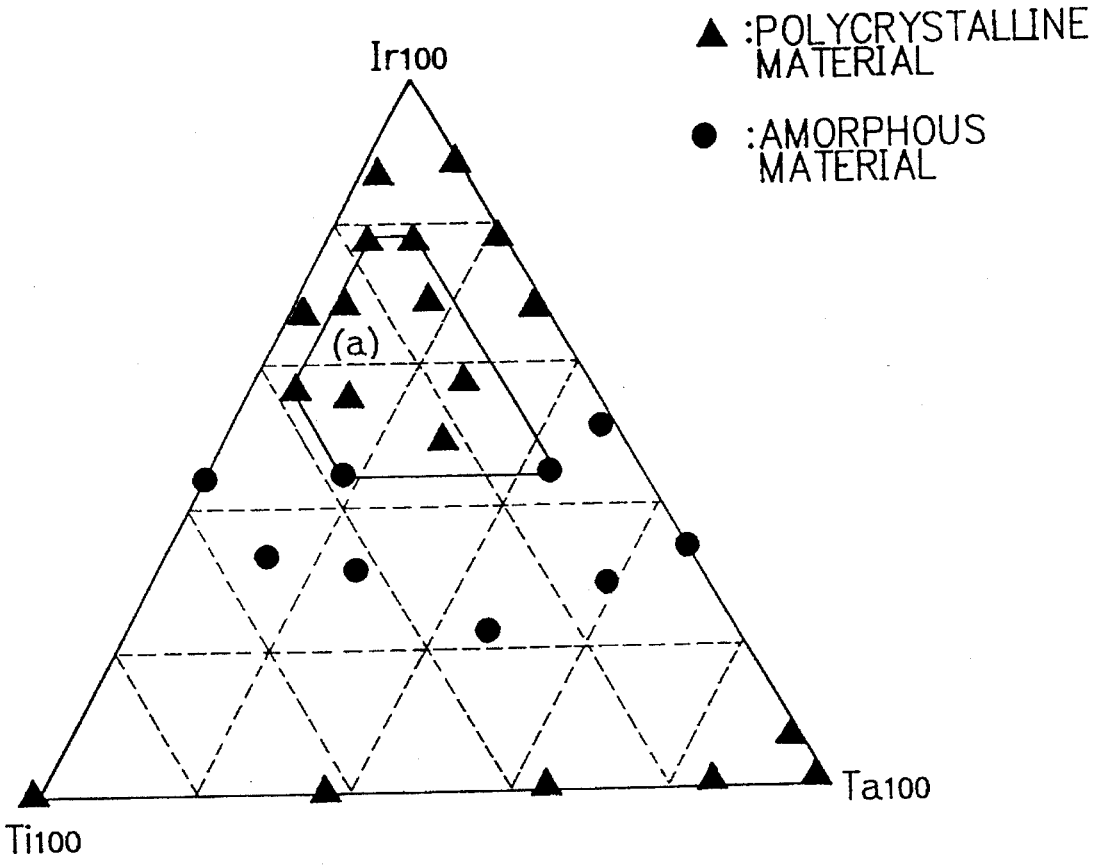

The results for Embodiment B-a: FIG. 7

Figure 8:
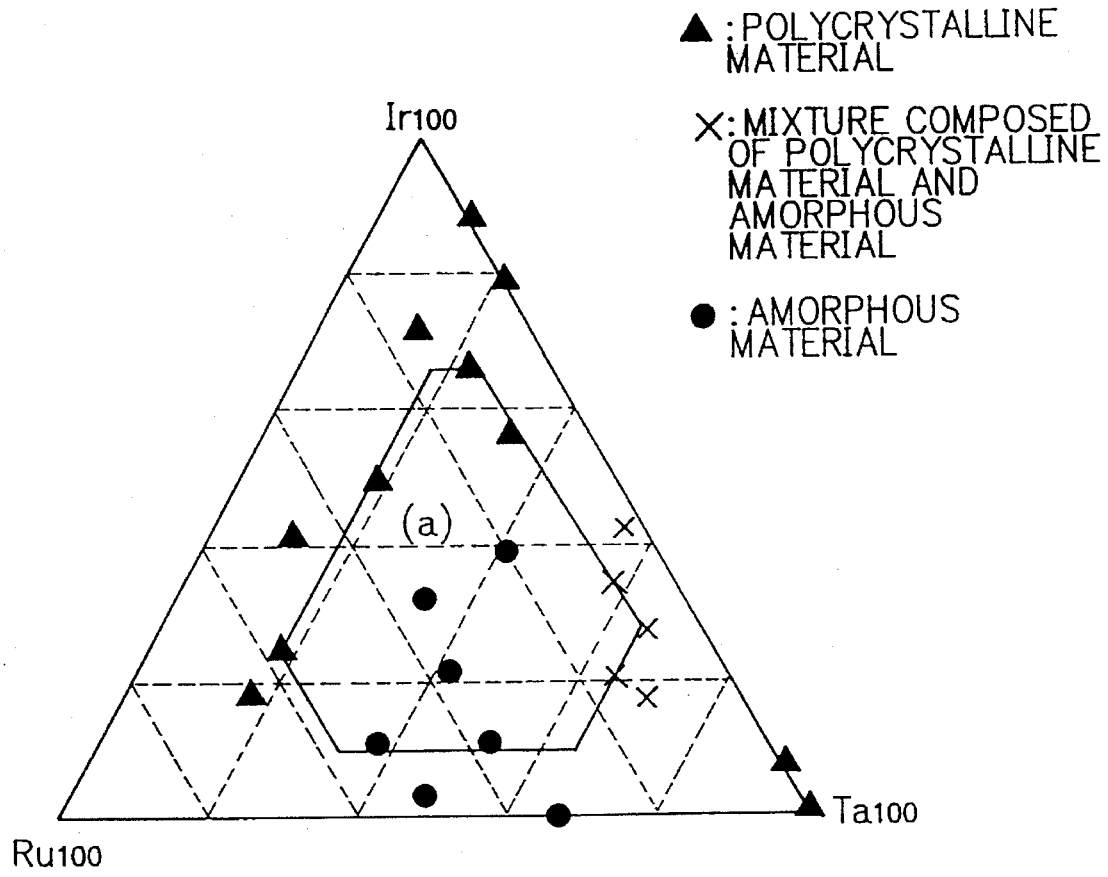

The results for Embodiment B-b: FIG. 8

Figure 9:
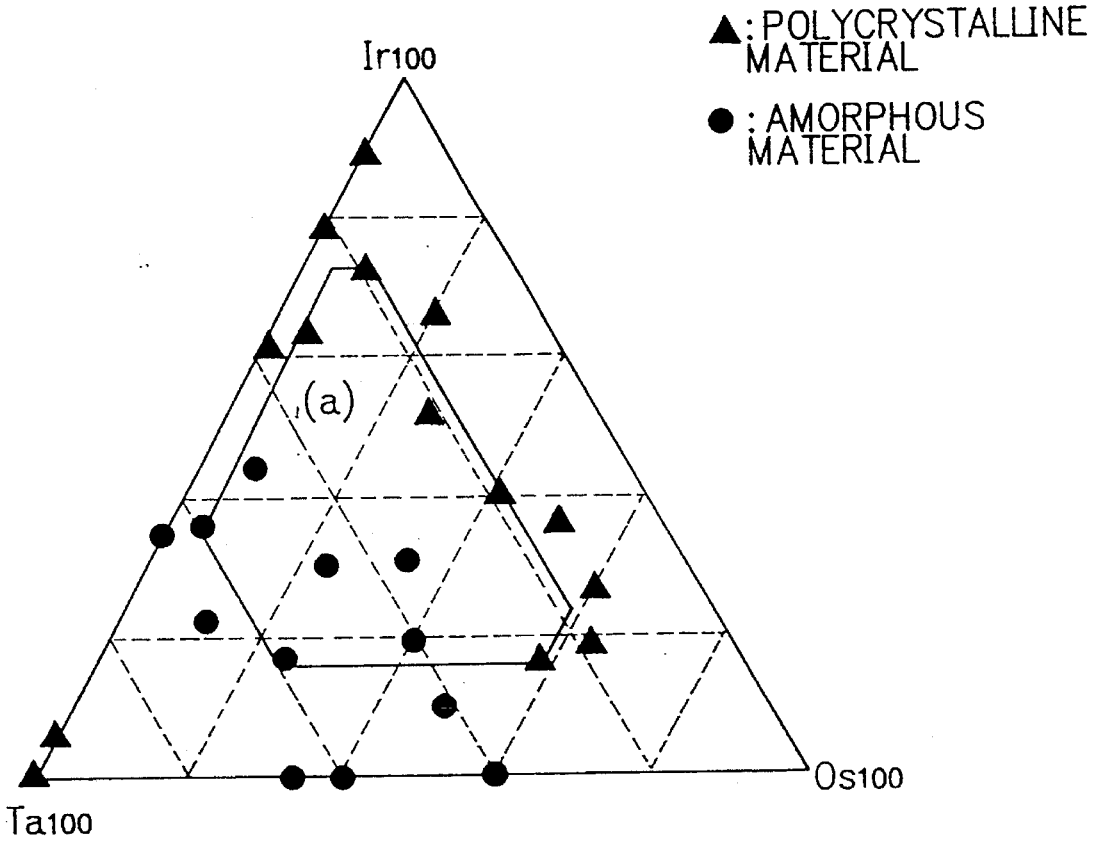

The results for Embodiment B-c: FIG. 9

Figure 10:
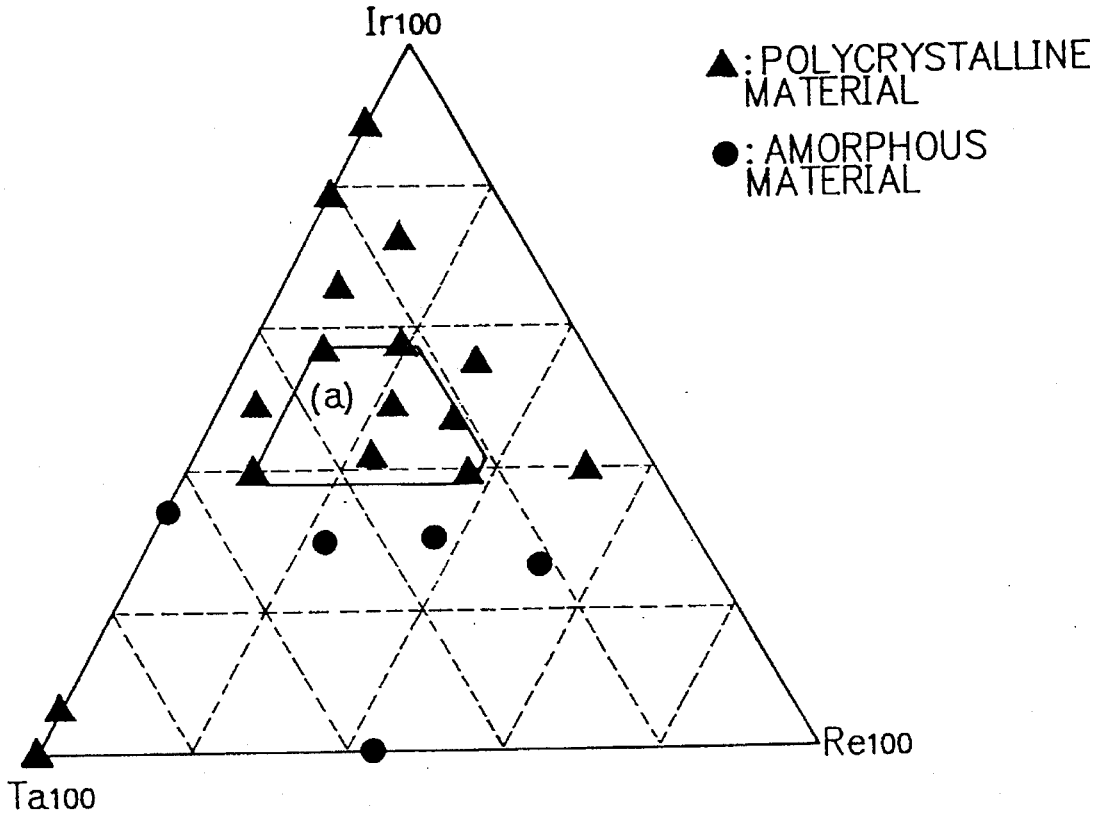

The results for Embodiment B-d: FIG. 10

Figure 11:
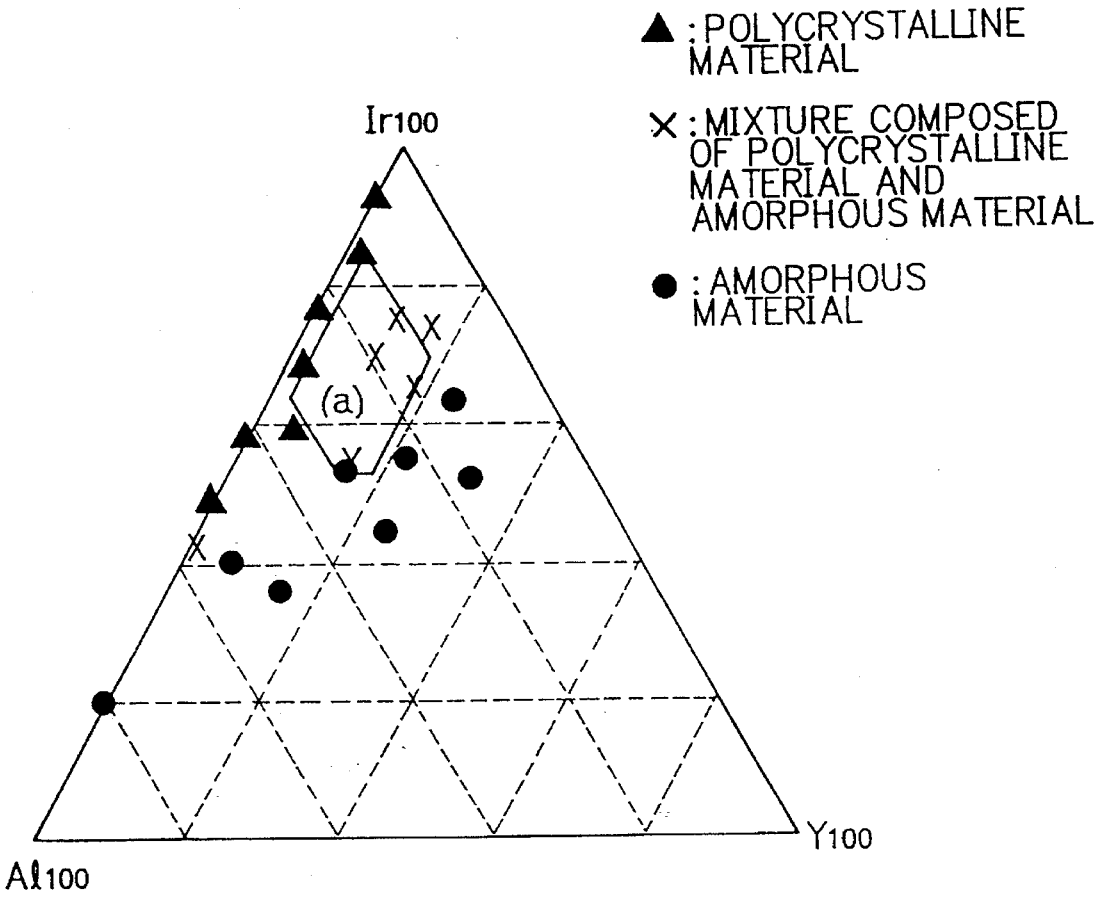

The results for Embodiment C: FIG. 11

Figure 12:
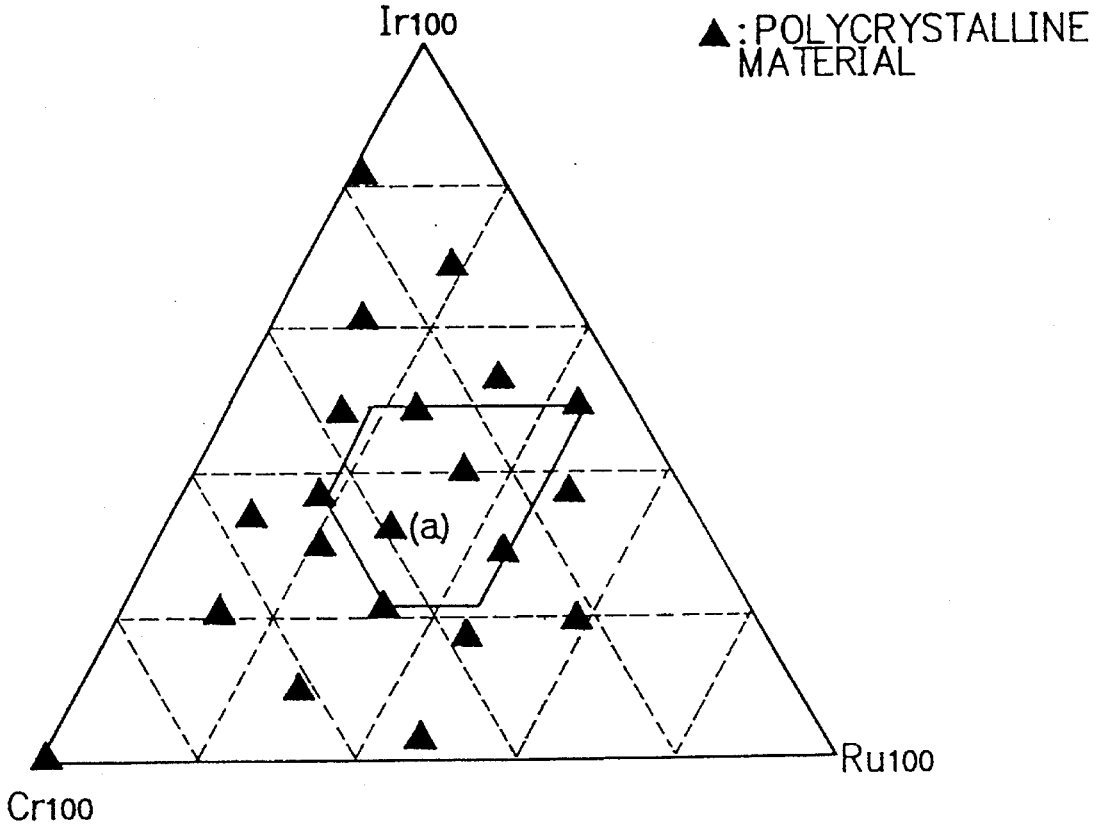

The results for Embodiment D: FIG. 12

Figure 14:
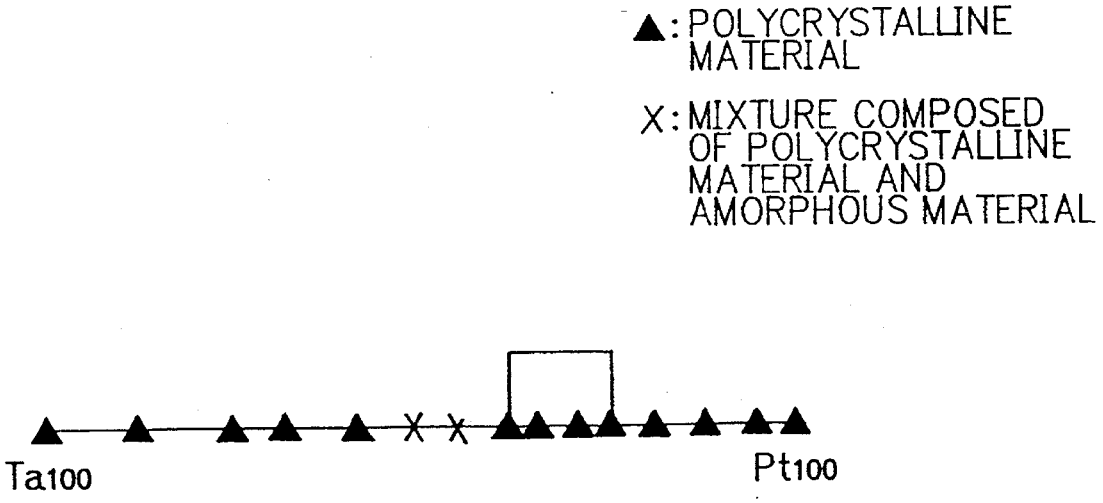

The results for Embodiment E: FIG. 14

In these figures, the mark ▲ indicates the case where the sample is of a polycrystalline material, the mark X indicates the case where the sample is of a mixture composed of polycrystalline material and amorphous material, and the mark ● indicates the case where the sample is of an amorphous material.

Subsequently, using some of the remaining samples which were prepared each by forming a film on the $SiO_2$ film of substrate, a so-called pond test was conducted in order to observe resistance to electrochemical reaction and resistance to mechanical shock. Further, using the remaining ones of the samples which were prepared each by forming a film on the $SiO_2$ film of substrate, a step stress test (SST) was conducted in order to observe heat resistance and resistance to shock in the air.

The above pond test was conducted in the same manner as in a "bubble resisting test in low conductivity ink" which will be hereinafter described, except that as the liquid for immersion, a liquid obtained by dissolving 0.15 wt. % of sodium acetate in a solution comprising 70 parts by weight of water and 30 parts by weight of diethylene glycol was used. The results of the pond test and the results of the SST were synthetically examined. The examined results will be under described.

As to Embodiment A, the present inventors obtained a finding that a non-single crystalline Ir-Cr material containing Ir and Cr as the essential constituents at the following respective composition rates is suitable for use as a heat generating resistor of an ink jet head.

24 atomic %≦Ir≦68 atomic %, and 32 atomic %≦Cr≦76 atomic %.

As to Embodiment B-a, the present inventors obtained a finding that a non-single crystalline Ir-Ta-Ti material containing Ir, Ta and Ti as the essential constituents at the following respective composition rates is suitable for use as a heat generating resistor of an ink jet head.

46 atomic %≦Ir≦78 atomic %, 5 atomic %≦Ta≦43 atomic %, and 10 atomic %≦Ti≦38 atomic %.

As to Embodiment B-b, the present inventors obtained a finding that a non-single crystalline Ir-Ru-Ta material containing Ir, Ru and Ta as the essential constituents at the following respective composition rates is suitable for use as a heat generating resistor of an ink jet head.

10 atomic %≦Ir≦67 atomic %, 11 atomic %≦Ru≦58 atomic %, and 18 atomic %≦Ta≦63 atomic %.

As to Embodiment B-c, the present inventors obtained a finding that a non-single crystalline Ir-Os-Ta material containing Ir, Os and Ta as the essential constituents at the following respective composition rates is suitable for use as a heat generating resistor of an ink jet head.

17 atomic %≦Ir≦73 atomic %, 5 atomic %≦ Os≦58 atomic %, and 19 atomic %≦Ta≦60 atomic %.

As to Embodiment B-d, the present inventors obtained a finding that a non-single crystalline Ir-Re-Ta material containing Ir, Re and Ta as the essential constituents at the following respective composition rates is suitable for use as a heat generating resistor of an ink jet head.

39 atomic %≦Ir≦58 atomic %, 9 atomic %≦Re≦36 atomic %, and 22 atomic %≦Ta≦51 atomic %.

As to Embodiment C, the present inventors obtained a finding that a non-single crystalline Ir-Y-Al material containing Ir, Y and Al as the essential constituents at the following respective composition rates is suitable for use as a heat generating resistor of an ink jet head.

54 atomic %≦Ir≦85 atomic %, 2 atomic %≦Y≦18 atomic %, and 13 atomic %≦Al≦30 atomic %.

As to Embodiment D, the present inventors obtained a finding that a non-single crystalline Ir-Ru-Cr material containing Ir, Ru and Cr as the essential constituents at the following respective composition rates is suitable for use as a heat generating resistor of an ink jet head.

21 atomic %≦Ir≦51 atomic %, 17 atomic %≦Ru≦42 atomic %, and 7 atomic %≦Cr≦46 atomic %.

As to Embodiment E, the present inventors obtained a finding that a non-single crystalline Pt-Ta material containing Pt and Ta as the essential constituents at the following respective composition rates is suitable for use as a heat generating resistor of an ink jet head.

62 atomic %≦Pt≦75 atomic %, and 25 atomic %≦Ta≦38 atomic %.

The present inventors prepared ink jet heads respectively having a heat generating resistor composed of one of these non-single crystalline materials. As a result, there were obtained facts which will be under described.

That is, in the case where any of the above-mentioned non-single crystalline materials is employed, an ink jet head having a heat generating resistor which excels especially in resistance to cavitation shock, resistance to erosion by cavitation, mechanical durability, electrochemical stability, chemical stability and heat resistance can be obtained. Particularly, there can be obtained ink jet heads of the configuration in which a heat generating portion of the heat generating resistor contacts directly with ink in the ink pathway. In any of the ink jet heads of this configuration, a high heat transfer efficiency to the ink is provided since heat energy caused from the heat generating portion of the heat generating resistor is subjected to directly effect the ink. Because of this, the power consumption by the heat generating resistor is restricted low, and the rise of temperature (the temperature variation) in the ink jet head is significantly reduced. Consequently, the ink jet head is free of the problem relative to occurrence of a variation in density of images obtained due to a variation in the temperature of the head. Further, there is provided an improved responsibility to an ink discharging signal applied to the heat generating resistor.

In addition, according to the heat generating resistor of the present invention, a desired specific resistance is provided with a high controllability such that a variation in resistance in a single ink jet head is extremely small.

Accordingly, there is provided an ink let head which enables to discharge ink in a markedly stabler state in comparison with the case in the prior art and which is also superior in terms of durability.

The ink jet head having such superior characteristics as above described is very suitable for achieving high speed recording of a high quality image in the case where the number of the ink discharging outlets is increased to be of a high density.

DETAILED DESCRIPTION OF THE PREFERRED EMBODIMENTS

The present invention is principally to provide an ink jet head having a heat generating resistor constituted by a material which exhibits a sufficient durability even in the case of driving the ink jet head with a relatively long drive pulse duration, wherein the material involves the merits of Ir which can exhibit superiority in terms of heat resistance, oxidation resistance and chemical stability. The principal feature of the present invention lies in the constitution of a heat generating body of an ink jet head which comprises a material containing Ir and other one specific element at respective specific composition rates or a material containing Ir and other two specific elements at respective specific composition rates.

The present invention includes a substrate for ink jet head which serves to constitute the above ink jet head and an ink jet apparatus provided with the ink jet head.

(Embodiment A)

The embodiment A of the present invention is to provide an ink jet head which includes an electrothermal converting body having a heat generating resistor capable of generating, upon energization, heat energy to be directly applied to ink on a heat acting face whereby discharging said ink, characterized in that said heat generating resistor is composed of a material substantially comprising Ir and Cr and containing the Ir and Cr at the following respective composition rates:

24 atomic %≦Ir≦68 atomic %, and 32 atomic %≦Cr≦76 atomic %.

In this embodiment, it is considered that the Ir excelling in heat resistance, oxidation resistance and chemical stability prevents occurrence of needless reactions; and the Cr not only provides a mechanical strength but also causes the formation of a stable oxide whereby bringing about a dissolution resisting property.

The present inventors have confirmed through experiments that in the case where a heat generating resistor for an ink jet head is formed using a non-single crystalline Ir-Cr material other than the above-mentioned specific Ir-Cr material, there are problems as follows. That is, such heat generating resistor is not adequate since it is inferior in resistance to cavitation shock, resistance to erosion by cavitation, electrochemical stability, chemical stability, heat resistance, adhesion, internal stress and the like, and when it is used as the heat generating resistor of an ink jet head, particularly as the heat generating resistor of an ink jet head of the configuration in which it directly contacts with ink, sufficient durability cannot be attained. For instance, in the case where the Ir is contained in an excessive amount, exfoliation of a film often takes place, and in the case where the Cr is contained in an excessive amount, the inherent resistance is sometimes greatly varied.

(Embodiment B-a)

The embodiment B-a of the present invention is to provide an ink jet head which includes an electrothermal converting body having a heat generating resistor capable of generating, upon energization, heat energy to be directly applied to ink on a heat acting face whereby discharging said ink, characterized in that said heat generating resistor is composed of a material substantially comprising Ir, Ta and Ti and containing the Ir, Ta and Ti at the following respective composition rates:

46 atomic %≦Ir≦78 atomic %, 5 atomic %≦Ta≦43 atomic %, and 10 atomic %≦Ti≦38 atomic %.

In this embodiment, it is considered that the Ir excelling in heat resistance, oxidation resistance and chemical stability prevents occurrence of needless reactions; the Ta not only provides a mechanical strength but also causes the formation of a stable oxide whereby bringing about a dissolution resisting property; and the Ti being present together with the above two elements imparts a malleability to the alloy material, makes the stress optimum and increases the adhesion and toughness.

The present inventors have confirmed through experiments that in the case where a heat generating resistor for an ink jet head is formed using a non-single crystalline Ir-Ta-Ti material other than the above-mentioned specific Ir-Ta-Ti material, there are problems as follows. That is, such heat generating resistor is not adequate since it is inferior in resistance to cavitation shock, resistance to erosion by cavitation, electrochemical stability, chemical stability, heat resistance, adhesion, internal stress and the like, and when it is used as the heat generating resistor of an ink jet head, particularly as the heat generating resistor of an ink jet head of the configuration in which it directly contacts with ink, sufficient durability cannot be attained. For instance, in the case where the Ir is contained in an excessive amount, exfoliation of a film often takes place, and in the case where either the Ta or the Ti is contained in an excessive amount, the inherent resistance is sometimes greatly varied.

(Embodiment B-b)

The embodiment B-b of the present invention is to provide an ink jet head which includes an electrothermal converting body having a heat generating resistor capable of generating, upon energization, heat energy to be directly applied to ink on a heat acting face whereby discharging said ink,. characterized in that said heat generating resistor is composed of a material substantially comprising Ir, Ru and Ta and containing the Ir, Ru and Ta at the following respective composition rates:

10 atomic %≦Ir≦67 atomic %, 11 atomic %≦Ru≦58 atomic %, and 18 atomic %≦Ta≦63 atomic %.

In this embodiment, it is considered that the Ir excelling in heat resistance, oxidation resistance and chemical stability prevents occurrence of needless reactions; the Ru excelling in oxidation resistance and chemical stability provides a mechanical strength and a resistance stability while causing the formation of an alloy with other metal elements; and the Ta being present together with the above two elements imparts a malleability to the alloy material, makes the stress optimum and increases the adhesion and toughness.

The present inventors have confirmed through experiments that in the case where a heat generating resistor for an ink jet head is formed using a non-single crystalline Ir-Ru-Ta material other than the above-mentioned specific Ir-Ru-Ta material, there are problems as follows. That is, such heat generating resistor is not adequate since it is inferior in resistance to cavitation shock, resistance to erosion by cavitation, electrochemical stability, chemical stability, heat resistance, adhesion, internal stress and the like, and when it is used as the heat generating resistor of an ink jet head, particularly as the heat generating resistor of an ink jet head of the configuration in which it directly contacts with ink, sufficient durability cannot be attained. For instance, in the case where either the Ir or the Ru is contained in an excessive amount, exfoliation of a film often takes place, and in the case where the Ta is contained in an excessive amount, the inherent resistance is sometimes greatly varied.

(Embodiment B-c)

The embodiment B-c of the present invention is to provide an ink jet head which includes an electrothermal converting body having a heat generating resistor capable of generating, upon energization, heat energy to be directly applied to ink on a heat acting face whereby discharging said ink, characterized in that said heat generating resistor is composed of a material substantially comprising Ir, Os and Ta and containing the Ir, Os and Ta at the following respective composition rates:

17 atomic %≦Ir≦73 atomic %, 5 atomic %≦Os≦58 atomic %, and 19 atomic %≦Ta≦60 atomic %.

In this embodiment, it is considered that the Ir excelling in heat resistance, oxidation resistance and chemical stability prevents occurrence of needless reactions; the Os not only provides a mechanical strength but also causes the formation of a stable oxide whereby bringing about a dissolution resisting property; and the Ta being present together with the above two elements imparts a malleability to the alloy material, makes the stress optimum and increases the adhesion and toughness.

The present inventors have confirmed through experiments that in the case where a heat generating resistor for an ink jet head is formed using a non-single crystalline Ir-Os-Ta material other than the above-mentioned specific Ir-Os-Ta material, there are problems as follows. That is, such heat generating resistor is not adequate since it is inferior in resistance to cavitation shock, resistance to erosion by cavitation, electrochemical stability, chemical stability, heat resistance, adhesion, internal stress and the like, and when it is used as the heat generating resistor of an ink let head, particularly as the heat generating resistor of an ink jet head of the configuration in which it directly contacts with ink, sufficient durability cannot be attained. For instance, in the case where the Ir is contained in an excessive amount, exfoliation of a film often takes place, and in the case where either the Ta or the Os is contained in an excessive amount, the inherent resistance is sometimes greatly varied.

(Embodiment B-d)

The embodiment B-d of the present invention is to provide an ink jet head which includes an electrothermal converting body having a heat generating resistor capable of generating, upon energization, heat energy to be directly applied to ink on a heat acting face whereby discharging said ink, characterized in that said heat generating resistor is composed of a material substantially comprising Ir, Re and Ta and containing the Ir, Re and Ta at the following respective composition rates:

39 atomic %≦Ir≦58 atomic %, 9 atomic %≦Re≦36 atomic %, and 22 atomic %≦Ta≦51 atomic %.

In this embodiment, it is considered that the Ir excelling in heat resistance, oxidation resistance and chemical stability prevents occurrence of needless reactions; the Re provides a mechanical strength and a heat resistance; and the Ta being present together with the above two elements imparts a malleability to the alloy material, makes the stress optimum and increases the adhesion and toughness.

The present inventors have confirmed through experiments that in the case where a heat generating resistor for an ink jet head is formed using a non-single crystalline Ir-Re-Ta material other than the above-mentioned specific Ir-Re-Ta material, there are problems as follows. That is, such heat generating resistor is not adequate since it is inferior in resistance to cavitation shock, resistance to erosion by cavitation, electrochemical stability, chemical stability, heat resistance, adhesion, internal stress and the like, and when it is used as the heat generating resistor of an ink jet head, particularly as the heat generating resistor of an ink jet head of the configuration in which it directly contacts with ink, sufficient durability cannot be attained. For instance, in the case where the Ir is contained in an excessive amount, exfoliation of a film often takes place, and in the case where either the Re or the Ta is contained in an excessive amount, the inherent resistance is sometimes greatly varied.

(Embodiment C)

The embodiment C of the present invention is to provide an ink jet head which includes an electrothermal converting body having a heat generating resistor capable of generating, upon energization, heat energy to be directly applied to ink on a heat acting face whereby discharging said ink, characterized in that said heat generating resistor is composed of a material substantially comprising Ir, Y and Al and containing the Ir, Y and Al at the following respective composition rates:

54 atomic %≦Ir≦85 atomic %, 2 atomic %≦Y≦18 atomic %, and 13 atomic %≦Al≦30 atomic %.

In this embodiment, it is considered that the Ir excelling in heat resistance, oxidation resistance and chemical stability prevents occurrence of needless reactions; the Y provides a mechanical strength and a resistance stability while causing the formation of an alloy with other metal elements; and the Al being present together with the above two elements imparts a malleability to the alloy material, makes the stress optimum and increases the adhesion and toughness.

The present inventors have confirmed through experiments that in the case where a heat generating resistor for an ink jet head is formed using a non-single crystalline Ir-Y-Al material other than the above-mentioned specific Ir-Y-Al material, there are problems as follows. That is, such heat generating resistor is not adequate since it is inferior in resistance to cavitation shock, resistance to erosion by cavitation, electrochemical stability, chemical stability, heat resistance, adhesion, internal stress and the like, and when it is used as the heat generating resistor of an ink jet head, particularly as the heat generating resistor of an ink jet head of the configuration in which it directly contacts with ink, sufficient durability cannot be attained. For instance, in the case where the Ir is contained in an excessive amount, exfoliation of a film often takes place, and in the case where either the Y or the Al is contained in an excessive amount, the inherent resistance is sometimes greatly varied.

(Embodiment D)

The embodiment D of the present invention is to provide an ink jet head which includes an electrothermal converting body having a heat generating resistor capable of generating, upon energization, heat energy to be directly applied to ink on a heat acting face whereby discharging said ink, characterized in that said heat generating resistor is composed of a material substantially comprising Ir, Ru and Cr and containing the Ir, Ru and Cr at the following respective composition rates:

21 atomic %≦Ir≦51 atomic %, 17 atomic %≦Ru≦42 atomic %, and 7 atomic %≦Cr≦46 atomic %.

In this embodiment, it is considered that the Ir excelling in heat resistance, oxidation resistance and chemical stability prevents occurrence of needless reactions; the Ru provides a mechanical strength while causing the formation of an alloy with other metal elements; and the Cr being present together with the above two elements imparts a malleability to the alloy material, makes the stress optimum and increases the adhesion and toughness.

The present inventors have confirmed through experiments that in the case where a heat generating resistor for an ink jet head is formed using a non-single crystalline Ir-Ru-Cr material other than the above-mentioned specific Ir-Ru-Cr material, there are problems as follows. That is, such heat generating resistor is not adequate since it is inferior in resistance to cavitation shock, resistance to erosion by cavitation, electrochemical stability, chemical stability, heat resistance, adhesion, internal stress and the like, and when it is used as the heat generating resistor of an ink Jet head, particularly as the heat generating resistor of an ink jet head of the configuration in which it directly contacts with ink, sufficient durability cannot be attained. For instance, in the case where either the Ir or the Ru is contained in an excessive amount, exfoliation of a film often takes place, and in the case where the Cr is contained in an excessive amount, the inherent resistance is sometimes greatly varied.

(Embodiment E)

The embodiment E of the present invention is to provide an ink jet head which includes an electrothermal converting body having a heat generating resistor capable of generating, upon energization, heat energy to be directly applied to ink on a heat acting face whereby discharging said ink, characterized in that said heat generating resistor is composed of a material substantially comprising Pt and Ta and containing the Pt and Ta at the following respective composition rates:

62 atomic %≦Pt≦75 atomic % and 25 atomic %≦Ta≦38 atomic %.

In this embodiment, it is considered that the Pt excelling in heat resistance, oxidation resistance and chemical stability prevents occurrence of needless reactions; and the Ta not only provides a mechanical strength but also causes the formation of a stable oxide whereby bringing about a dissolution resisting property. The present inventors have confirmed through experiments that in the case where a heat generating resistor for an ink Jet head is formed using a non-single crystalline Pt-Ta material other than the above-mentioned specific Pt-Ta material, there are problems as follows. That is, such heat generating resistor is not adequate since it is inferior in resistance to cavitation shock, resistance to erosion by cavitation, electrochemical stability, chemical stability, heat resistance, adhesion, internal stress and the like, and when it is used as the heat generating resistor of an ink jet head, particularly as the heat generating resistor of an ink jet head of the configuration in which it directly contacts with ink, sufficient durability cannot be attained. For instance, in the case where the Pt is contained in an excessive amount, exfoliation of a film often takes place, and in the case where the Ta is contained in an excessive amount, the inherent resistance is sometimes greatly varied.

As above described, in any of the non-single crystalline materials containing Ir and other one specific element at the foregoing respective specific respective composition rates and the non-single crystalline materials containing Ir and other two specific elements at the foregoing respective specific composition rates in the present invention, the specific two or three elements are organically effected with each other in a desired state and because of this, any of these non-single crystalline materials may be employed as a heat generating resistor capable of being directly contacted with any kind of ink over a long period of time.

The heat generating resistor in the present invention is composed of one of the foregoing non-single crystalline materials including amorphous alloys, polycrystalline alloys and mixtures of these materials.

The layer thickness of the heat generating resistor in the present invention should be properly determined so that adequate energy is effectively generated. However, in general, it is preferably in the range of 300 Å to 1 μm or more preferably, in the range of 1000 Å to 5000 Å from the viewpoints of durability and productivity.

The heat generating resistor in the present invention is not always necessary to be structured such that the composition of the given constituent elements is uniform in the entire layer region, as long as these constituent elements at the surface layer region to be contacted with ink are of the respective composition rates within the above-described specific ranges. Particularly, it is possible for the heat generating resistor to be of a multi-layered structure or to be comprised of such a layer in which the composition of the given constituent elements is unevenly distributed in the thickness direction as long as the above conditions are satisfied. In any of these cases, the advantages of the present invention are attained, wherein the adhesion with a substrate for ink jet head is secured as desired. For example, as to the heat generating resistor of the present invention which is comprised of Cr, Ta and Al or Ti, when the heat generating resistor is made to have a multi-layered structure having a lower layer containing Cr, Ta, Al or Ti in a relatively greater amount or when the heat generating resistor is made to have a single layer structure having a lower layer region containing Cr, Ta, Al or Ti With a distribution of a relatively greater concentration, the adhesion with a substrate for ink jet head is secured as desired.

Usually, the surface or the inside of a layer constituting the heat generating resistor is sometimes oxidized upon contact with the atmospheric air or during the formation process thereof wherein gaseous materials are sometimes incorporated thereinto. However, any of the materials used in the present invention does not deteriorate the effects thereof even when the surface or the inside of the layer constituting the heat generating resistor is slightly oxidized or even when Ar is incorporated thereinto. As such impurities, there can be illustrated, beginning with Ar and O, at least an element selected from C, N, Si, B, Na, Cl and Fe.

The heat generating resistor in the present invention may be properly formed, for example, by a DC sputtering method wherein individual materials are simultaneously or alternately deposited, a RF sputtering method, an ion beam sputtering method, a vacuum evaporation method or a CVD method.

In the following, description will be made of an ink jet head according to the present invention which has a heat generating resistor comprised of an alloy material with any of the foregoing compositions and which excels in thermal efficiency, signal responsibility and so forth while referring to the drawings.

Figure 1A:
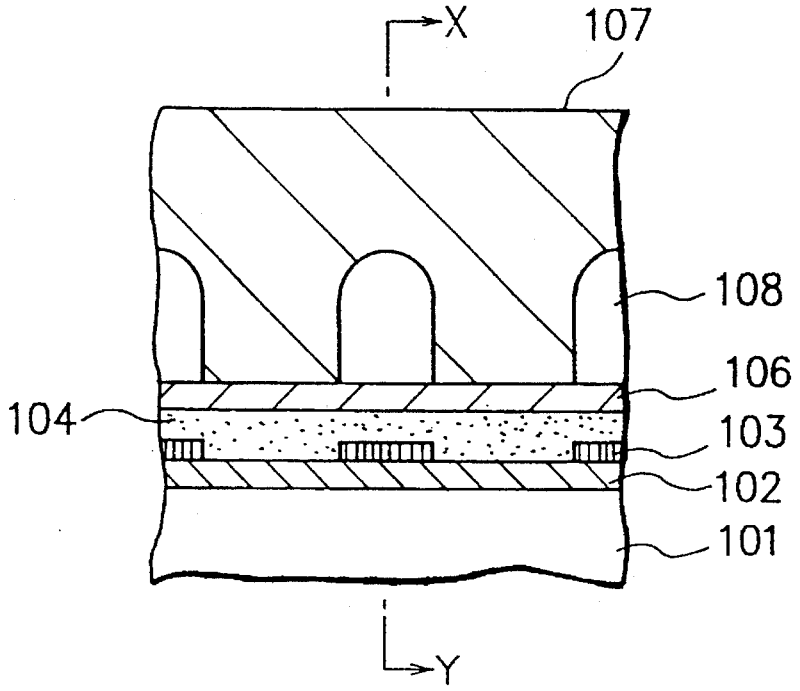
FIG. 1(*b*) is a schematic sectional view taken along the line X-Y in FIG. 1(*a*)
Figure 1B:
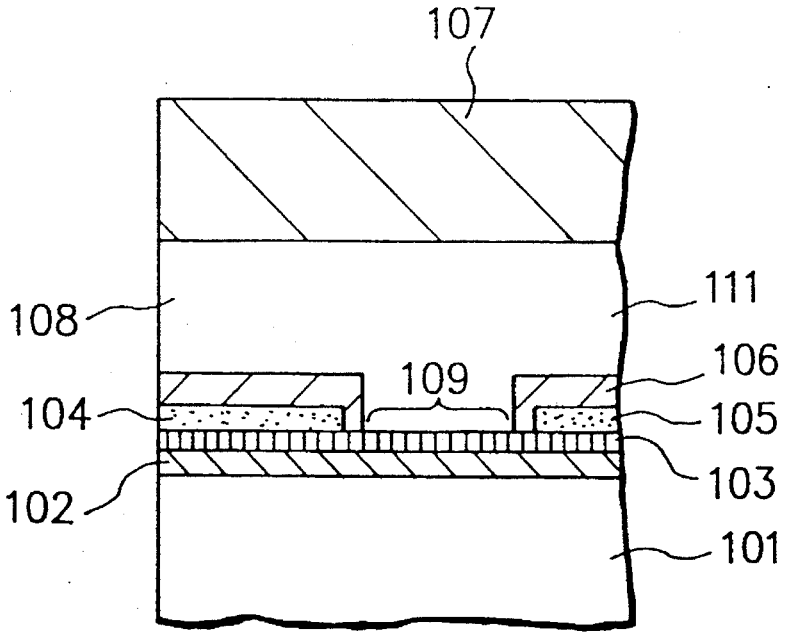

FIG. 1(*a*) is a schematic front view of a principal portion of an example of the ink jet head as viewed from the discharging outlet side; and FIG. 1(*b*) is a schematic sectional view, taken along the line X-Y in FIG. 1(*a*).

The ink jet head of this example is of a basic configuration wherein an electrothermal converting body having a heat generating resistor layer 103 with a given shape and electrodes 104 and 105 is formed on a support comprising a lower layer 102 disposed on a surface of a base member 101, a protective layer 106 is disposed so as to cover at least the electrodes 104 and 105 of the electrothermal converting body, and a grooved plate 107 having recessed portions for providing liquid pathways 111 in communication with discharging outlets 108 is disposed on the protective layer.

The electrothermal converting body in this example includes the heat generating resistor layer 103, the electrodes 104 and 105 connected to the heat generating resistor layer 103, and the protective layer 106 which is disposed in case where necessary. The substrate for ink jet head herein includes the support comprising the base member 101 and the lower layer 102, the electrothermal converting body and the protective layer 106. In the ink jet head of this example, a heat acting face 109 which directly transmit heat to ink is substantially the same as a face of a portion (heat generating portion) of the heat generating resistor layer 103 which is situated between the electrodes 104 and 105 and contacts with ink, and corresponds to a portion of the heat generating portion which is not covered by the protective layer 106.

The lower layer 102 is disposed in case where necessary, which functions to efficiently transmit energy generated by the heat generating portion to ink while regulating the amount of the energy to escape to the side of the base member 101.

The electrodes 104 and 105 serve to energize the heat generating resistor layer 103 in order to make the heat generating portion generate heat. In this example, the electrode 104 is a common electrode for the individual heat generating portions, and the electrode 105 is a selective electrode which serves to separately energize each heat generating portion.

The protective layer 106 is disposed in case where necessary. The protective layer is provided for the purpose of preventing the electrodes 104 and 105 from contacting with and being corroded by ink or for the purpose of preventing the electrodes from being short-circuited through ink.

Figure 2A:
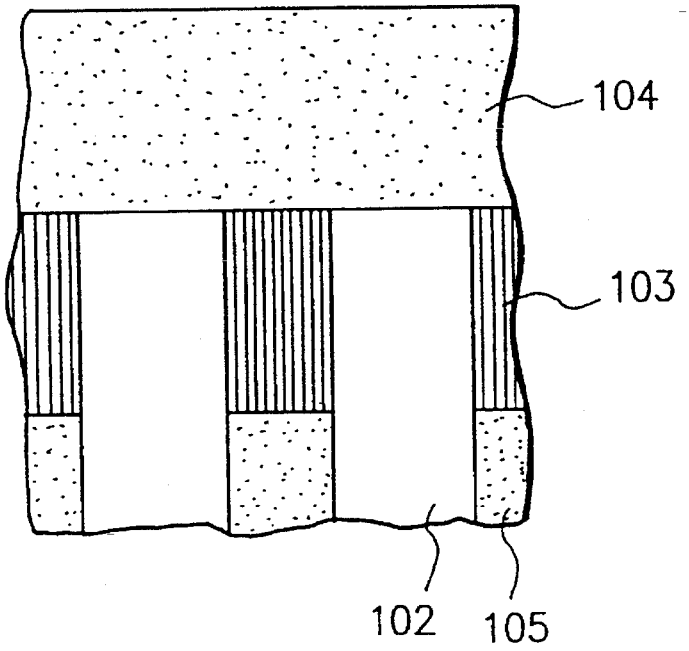
FIG. 2(*a*) is a schematic plan view of a substrate for ink jet head at a stage at which a heat generating resistor layer and electrodes are provided.
Figure 2B:
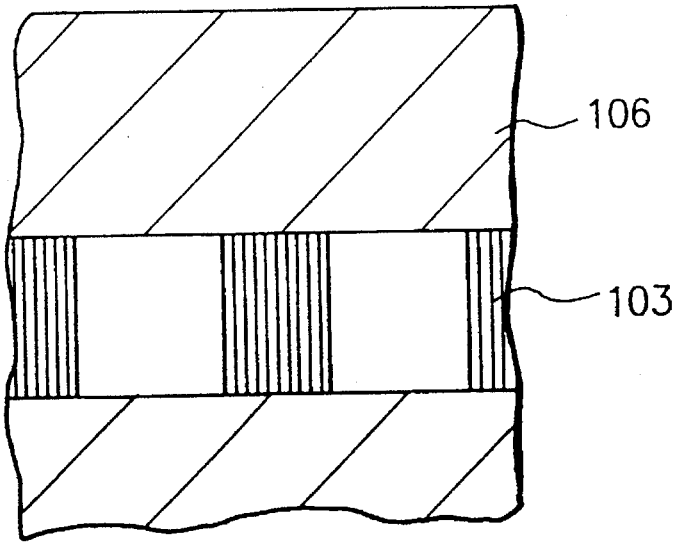

FIG. 2(*a*) is a schematic plan view of the substrate for ink jet head at the stage wherein the heat generating resistor layer 103 and the electrodes 104 and 105 are disposed. FIG. 2(*b*) is a schematic plan view of the substrate for ink jet head at the stage wherein the protective layer 106 is disposed over those above described.

In the ink jet head of this example, an alloy material of any of the above-described compositions is employed as the heat generating resistor layer 103, and although the ink jet head is of the configuration wherein the heat acting face 109 contacts directly with ink, the ink jet head excels in durability. Thus, it is possible to take such a configuration that a heat generating portion of a heat generating resistor which serves as a heat energy source contacts directly contacts with ink. This configuration makes it possible to directly transmit heat generated by the heat generating portion to the ink, wherein surpassingly efficient heat transmission is achieved in comparison with an ink jet head of other configuration wherein heat is transmitted through a protective layer or the like to ink and therefore, not only the power consumption by the heat generating resistor is restricted low but also the degree of a rise in temperature of the ink jet head is desirably diminished. In addition, the responsibility to a signal (a discharging instruction signal) inputted is improved and a desirable bubble producing condition necessary for discharging is stably provided.

The configuration of the electrothermal converting body having a heat generating resistor formed of one of the alloy materials according to the present invention is not limited only to the one shown in FIGS. 1 and 2 but it may take other appropriate configurations.

Figure 3:
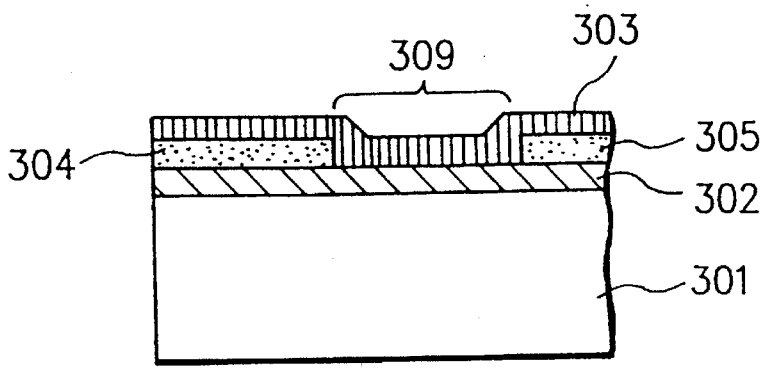
FIG. 3 is a schematic sectional view illustrating an essential constitution of other example of an ink jet head of the present invention.

FIG. 3 is a schematic sectional view illustrating a principal part of other example of the ink jet head according to the present invention.

In this example, there is disposed an electrothermal converting body having a heat generating resistor layer 303 with a given shape and electrodes 304 and 305 is formed on a support comprising a lower layer 302 disposed on a surface of a base member 301. In the substrate for ink jet head of this example, both the electrodes 304 and 305 are covered by the heat generating resistor layer 303 composed of an alloy material of any of the above-described compositions wherein no protective layer is disposed for the electrodes.

In the configuration shown in FIGs. 1(*a*) and 1(*b*), the direction in which ink is supplied to the heat acting face 109 is substantially the same as the direction in which ink is discharged from the discharging outlet 108 making use of heat energy generated by the heat generating portion. The constitution of the discharging outlet and that of the liquid pathway are, however, not always necessary to be like this. Particularly, these directions may be designed such that they are different from each other.

Shown in FIG. 4 is a schematic sectional view illustrating a principal part of a further example of the ink jet head according to the present invention.

This example is of a configuration shown in a schematic plan view of FIG. 4(*a*) and a schematic sectional view of FIG. 4(*b*), taken along the line A-B in FIG. 4(*a*), wherein the direction of a discharging outlet of a ink jet head is made to be substantially perpendicular to the direction of its liquid pathway. In FIG. 4, reference numeral 410 indicates a discharging outlet plate comprising a plate having a desired thickness which is provided with a plurality of discharging outlets, and reference numeral 412 indicates a supporting member which serves to support the discharging outlet plate 410. Other constituents than these are the same as those, in FIGS. 1 and 2. Of these constituents, explanation will not be made herein, except that each of them is indicated by the corresponding reference numeral employed in FIGS. 1 and 2.

The ink jet head according to the present invention may be designed such that a plurality of ink discharging structure units each having a discharging outlet, liquid pathway and heat generating portion are arranged as shown in FIG. 1 or 3. The present invention is particularly effective in the case where a plurality of such ink discharging structure units are arranged at a high density, for example, at such a high density as 8 units/mm or more, or 12 units/mm or more. As an example of having a plurality of ink discharging structure units like this, there can be mentioned a so-called full line type ink jet head of the configuration in which the ink discharging structure units are arranged over the full width of a recording area of a member on which record is performed.

In the case of such a so-called full line type ink jet head of the configuration in which a plurality of discharging outlets are disposed so as to correspond to the width of a recording area of a member on which record is performed, or in other words, in the case of an ink jet head in which 1,000 or more or 2,000 or more discharging outlets are arranged, a variation in inherent resistance of the heat generating portion in the one ink jet head has an influence upon the uniformity in volume of droplets discharged from the discharging outlets, sometimes resulting in causing the formation of record images varied in density. However, in the case of using the heat generating resistor according to the present invention, a desired specific resistance is obtained with a good controllability such that a variation in inherent resistance of the heat generating portion in a single ink jet head is reduced very small and because of this, the above problem is eliminated with a markedly good condition.

Thus, the heat generating resistor according to the present invention plays a progressively important role under the situation of a tendency that an increase in recording speed (for example, to a level of 30 cm/sec. or more, or further, 60 cm/sec. or more in terms of printing speed) and an increase in density of the discharging outlets to be arranged are demanded and the number of discharging outlets of an ink jet head is increased in order to cope with such demands.

Further, in an ink jet head of such a configuration as described in U.S. Pat. No. 4,429,321 wherein a functional element is structurally installed in the inside of a surface of a substrate for ink jet head, it is one of the important factors to form an electric circuit for the entire of the ink jet head precisely as originally designed so that the functions of the functional element can be readily maintained in a normal state. The heat generating resistor according to the present invention works very effectively also in this meaning. Particularly, as above described, in the case of using the heat generating resistor according to the present invention, a desired specific resistance is obtained with a good controllability such that a variation in inherent resistance of the heat generating portion in a single ink jet head is reduced very small and because of this, an electric circuit for the entire of an ink jet head can be formed precisely as originally designed.

In addition, the heat generating resistor according to the present invention is very effective for an ink jet head of a disposal cartridge type which integrally includes an ink tank for storing therein ink to be supplied to a heat acting face. Particularly, it is required for the ink jet head of this configuration to be low in the running cost with respect to the entire of an ink jet apparatus in which the ink jet head is mounted. However, as above described, in the case of using the heat generating resistor according to the present invention, it can establish such a configuration that the heat generating resistor directly contacts with ink, wherein the efficiency of heat to be transferred to ink is improved, and therefore, the power consumption for the entire apparatus is eventually reduced. Thus, it is possible to readily fulfill the above requirement.

Now, the ink jet head according to the present invention may be configured such that a protective layer is disposed on the heat generating resistor. In this case, the resulting ink jet head becomes such that the durability of the electrothermal converting body is further improved and occurrence of a variation in inherent resistance of the heat generating resistor due to electrochemical reaction is further diminished, although the efficiency of heat to be transferred to ink is somewhat sacrificed.

In the case where the protective layer is provided as above described, the entire thickness thereof is desired to be in the range of 1000 Å to 5 μm. Specifically, in a preferred embodiment of such protective layer, it comprises a Si-containing insulating layer comprising $SiO_2$, SiN or the like disposed on the heat generating resistor and an Al layer disposed on said layer so as to establish a heat acting face.

The heat generating resistor according to the present invention is not limited only for use for generating heat to be utilized for discharging ink. It may be used as a heater for heating a desired portion which is disposed in the ink jet head in case where necessary, and it may be used particularly suitably in the case where such heater contacts directly with ink.

There is afforded an ink jet recording apparatus which enables to perform high speed recording resulting high quality record images by mounting an ink let head of the foregoing configuration to an apparatus body such that a signal from the apparatus body can be applied to the ink jet head.

FIG. 5 is a schematic perspective view illustrating an example of an ink jet recording apparatus IJRA in which the present invention is employed. In the figure, a carriage HC held in engagement with a spiral groove 5004 of a lead screw 5005 which is rotated by way of driving force transmitting gears 5011 and 5009 in response to forward or rearward rotation of a driving motor 5013 has a pin (not shown) and is moved back and forth in the directions of arrow marks a and b. Reference numeral 5002 indicates a paper holding plate, which presses a paper against a platen 5000 over the direction of movement of the carriage. Reference numerals 5007 and 5008 indicate a photocoupler and home position detecting means for confirming the presence of a lever 5006 of the carriage in this region to effect reversal of the direction of rotation or the like of the motor 5013. Reference numeral 5016 indicates a member for supporting thereon a cap member 5022 provided for capping a front face of a ink jet recording head IJC of a cartridge type in which an ink tank is integrally provided. Reference numeral 5015 indicates sucking means for sucking the inside of the cap, and the sucking means effects sucking restoration of the ink jet recording head by way of an opening 5023 in the cap. Reference numeral 5017 indicates a cleaning blade, reference numeral 5019 indicates a member for making the blade possible to move in backward and forward directions, and these are supported on a body supporting plate 5018. The blade is not limited only to this form. It is a matter of course to say that a conventional cleaning blade can be employed in this example. Reference numeral 5012 indicates a lever for starting sucking for the sucking restoration, and the lever 5012 is moved upon movement of a cam 5020 which engages with the carriage, and the driving force from the driving motor is controlled for movement by known transmitting means such as changing over of a clutch. A CPU which serves to supply a signal to the electrothermal converting body installed in the ink jet head IJC or to execute driving control of the above various mechanisms is disposed on the apparatus body side (not shown).

It should be noted that as to the ink jet head and the ink jet apparatus of the present invention, portions other than the foregoing heat generating resistor can be properly formed using the known materials by means of conventional methods.

EXAMPLES

In the following, the present invention will be described in more detail with reference to detailed examples.

Examples corresponding to the embodiment A

Example A-1

A Si single crystal base member (produced by Wacker Company) and another Si single crystal base member (produced by Wacker Company) having a 2.5 μm thick $SiO_2$ film formed on the surface thereof, respectively as the base member 603 for sputtering, were placed on the base member holder 602 situated in the film-forming chamber 601 of the foregoing high frequency sputtering apparatus shown in FIG. 6. Using a composite target comprised of a Cr target 606 of more than 99.9 wt. % in purity and two Ir targets 607, respectively comprising an Ir sheet of around the same purity as that of the Cr target, being disposed on the Cr target, sputtering was conducted under the following conditions to form an about 2000 Å thick alloy layer.

Sputtering Conditions:

Target area ratio Cr: Ir=61:39

Target area 5 inch (127 mm) in diameter

High frequency power applied 1000 W

Film formation period 12 minutes

Base member temperature 50° C.

Base pressure $2.6\times10^{-4}$ Pa or less

Sputtering gas pressure 0.4 Pa (argon)

Further, as to the base member with the $SiO_2$ film on which the alloy layer was formed, the composite target was replaced by an Al target only, followed by conducting sputtering by a conventional sputtering technique, to thereby form a 6000 Å thick Al layer to be the electrodes 104 and 105 (see, FIG. 1) on the alloy layer.

Thereafter, photoresist was formed twice in a predetermined pattern by means of a photolithography technique. The resultant was subjected to etching treatments, wherein firstly, the Al layer was subjected to wet etching treatment, and secondly, the alloy layer was subjected to dry etching treatment by way of ion trimming, to thereby form a heat generating resistor 103 and electrodes 104 and 105 of such shapes as shown in FIG. 1(*b*) and FIG. 2(*a*). In this case, a plurality of groups each comprising 24 heat generating portions of 30 μm×170 μm in size being arranged in a raw at a pitch of 125 μm were formed on the $SiO_2$ film.

Subsequently, a $SiO_2$ film was formed over the resultant by means of a sputtering technique, followed by patterning the $SiO_2$ film using a photolithography technique and a reactive ion etching technique so as to cover over portions of 10 μm wide on the opposite sides of the heat generating portions and the electrodes, whereby forming a protective layer 106. The size of each of the heat generating portions 109 was 30 μm×150 μm.

The product in such state was cut into respective groups, to thereby obtain a plurality of substrates for ink jet head. Evaluation tests which will be hereinafter described were conducted for some of these substrates.

As to the remaining substrates, a grooved plate 107 made of glass was joined to each of them in order to form discharging outlets 108 and liquid pathways 111 shown in FIG. 1(*a*) and FIG. 1(*b*), to thereby obtain a plurality of ink jet heads.

Each of the ink jet heads thus obtained was set to a recording apparatus of a known constitution, and recording was performed. As a result, in any case, recording could be performed with a high discharging stability and with a high signal responsibility, wherein high quality record images were provided. And, any of the ink jet heads was found to have a good durability upon use in the apparatus.

(1) Analysis of Film Composition

EPMA (electron probe microanalysis) was conducted for the heat acting portion with no protective layer under the following conditions using the foregoing measuring instrument in order to find the composition of the constituent material.

| | |
|---|---|
| Acceleration voltage | 15 kV |
| Probe diameter | 10 μm |
| Probe electric current | 10 nA |

As for each sample, the quantitative analysis was conducted only for the principal constituent elements of the targets as the raw materials but not for argon, which is usually taken into a film formed by a sputtering technique, and carbon and oxygen possibly having been deposited on the surface thereof. With respect to other impurity elements, it was confirmed not only by the quantitative analysis but also by a qualitative analysis that those impurity elements of any sample were lower than a detection error (about 0.2 wt. %) of the analyzing instrument.

(2) Measurement of Film Thickness

Measurement of the film thickness of each sample was conducted by measuring a step using a contour measuring instrument of the tracer type (Alpha-Step 200, produced by Tencor Instruments Company). The results obtained are shown in Table 1.

(3) Measurement of Crystallinity

As for the sample having a film formed on the Si single crystal base member, its crystallinity was observed by measuring a X-ray diffraction pattern using the foregoing measuring instrument. The crystallinity of the sample was identified by one of three sorts, namely, (C): a film for which an acute peak due to crystal appeared; (A): a film for which no acute peak appeared and which was considered to be in an amorphous state; and (M): a film which was considered to be composed of a mixture of crystalline and amorphous materials. The results obtained are shown in Table 1.

(4) Measurement of Specific Resistance

A specific resistance was calculated from the film thickness and a sheet resistance which was measured using a 4-probe resistance meter (K-705RL, produced by Yugen Kaisha Kyowariken). The results obtained are shown in Table 1.

(5) Measurement of Density

A variation in weight of the base member before and after the film formation was measured using an ultra-microbalance produced by Inaba Seisakusho Ltd., and a density was calculated from a value obtained by this measurement and the thickness and area of the film. The results obtained are shown in Table 1.

(6) Measurement of Internal Stress

A warp was measured for the two elongated glass base members before and after the film formation, and the quantity of a variation with respect to warp was obtained based on the measured results. A internal stress was found out by a calculation from the resultant variation quantity, a length, thickness Young's modulus and Poisson's ratio of the glass base member, and the thickness of the film formed. The results obtained are shown in Table 1.

(7) Bubble Endurance Test in Ink with Low Conductivity

The device (the substrates for ink jet head) obtained precedently at the stage at which neither discharging outlets nor liquid pathways were formed was immersed into ink with a low conductivity (clear ink) described below through its portion at which the protective layer 106 was provided, and a rectangular wave voltage having a width of 7 μsec and a frequency of 5 kHz from an external power source was applied to the electrodes 104 and 105 while gradually raising the voltage whereby obtaining a bubble reduction threshold voltage ($V_{th}$).

| Ink Composition: | |
|---|---|
| water | 70 parts by weight |
| Diethylene glycol | 30 parts by weight |
| Ink conductivity | 25 μS/cm |

Subsequently, a pulse voltage equal to 1.1 times the voltage $V_{th}$ was applied in the ink to repeat production of bubbles to measure the number of application pulses until each of the 24 heat acting portions 109 was brought into a broken condition, and a mean value of them was calculated (such bubble endurance test in ink will be hereinafter called commonly as "pond test").

The resultant value is described in Table 1 as a ratio obtained by dividing the resultant mean value by a value corresponding to ⅖ of a mean value obtained in Comparative Example A-1, which will be later described, in the same manner as in the instant Example.

It is to be noted that, since the ink with the above composition is low in conductivity, the influence of electrochemical reaction is slight, and a principal factor of causing the breakage is erosion or thermal shock by cavitation. Thus, a durability for the erosion and thermal shock can be found out by the present test.

(8) Bubble Endurance Test in Ink with High Conductivity

Bubble endurance test was conducted in ink with a high conductivity (black ink) described below in the same manner as in the case (7).

The resultant value is described in Table 1 as a ratio obtained by dividing the resultant mean value by a value corresponding to ⅖ of a mean value obtained in Comparative Example A-1, which will be later described, in the same manner as in the case of (7).

Not only the number of pulses applied but also a variation in inherent resistance of the heat generating resistor before and after the application of the pulse signals were also measured.

| Ink Composition: | |
|---|---|
| Water | 68 parts by weight |
| Diethylene glycol | 30 parts by weight |
| Black dyestuff (C.I. Hood Black 2) | 2 parts by weight |
| PH adjustor (sodium acetate) | slight amount (adjusted to PH 6 to 7) |
| Ink conductivity | 2.6 mS/cm |

In this test, the ink is so high in conductivity that electric current flows also in the ink upon the application of a voltage. Therefore, in addition to erosion by cavitation, whether or not electrochemical reaction provides a damage to the heat generating resistor can be discriminated according to this test.

(9) Step Stress Test (SST)

Step stress test was conducted in the air wherein a pulse voltage was successively increased for a fixed step ($6\times10^5$ pulses, 2 minutes) while employing similar pulse width and frequency as in the cases (7) and (8), whereby finding out a ratio (M) between a breakdown voltage ($V_{break}$) and the $V_{th}$ obtained in the case (7) and estimating a temperature to which the heat acting face reached at the $V_{break}$. The results obtained are shown in Table 1.

From the results, a heat resistance and a resistance to thermal shock in the air can be discriminated.

(10) Evaluation with Actual Ink Jet Head

| Printer driving conditions: | |
|---|---|
| Discharging outlet number | 24 |
| Driving frequency | 2 kHz |
| Driving pulse width | 20 μsec |
| Driving voltage | 1.2 times as much as the discgarging threshold voltage ($V_{th}$) |
| Ink | same as the black ink used in the pond test |

(i) Print Quality

Printing of Chinese characters was performed using the ink jet head. The resultant was evaluated by eyes based on the following criteria: ○ for the case where excellent print was obtained, Δ for the case where good print was obtained, and X for the case where troubles such as non-discharging, blurring, and the like took place. The results obtained are shown in Table 1.

(ii) Durability

There were used three ink jet heads for each heat generating resistor. Each of the ink jet head was evaluated after performing printing of 2,000 A4-size sheets based on the following criteria: ○ for the case where all the three ink jet heads worked normally and provided excellent prints, and X for the case where troubles such as failure took place with at least one of the heat generating resistors of the three ink jet heads. The results obtained are shown in Table 1.

(11) Total Evaluation

Total evaluation was conducted based on the following criteria. The results obtained are shown in Table 1.

○: the case where the result of the endurance test by the pond test in low conductivity ink: $6\times10^7$; the result of the endurance test by the pond test in high conductivity ink: $\geqq3\times10^7$; the resistance variation: 5%; SST M: $\geqq1.7$; and the evaluated result of each of the two evaluation items print quality and durability is ○. X: the case where any of the result of the pond test in low conductivity ink, the resistance variation and the SST M is evaluated as being lower than Δ in integrated evaluation, or the case where the evaluated result of one of the two evaluation items print quality and durability is X.

Examples A-2 to A-4

In each case, the procedures of Example A-1 were repeated, except that upon forming the heat generating resistor, the area ratio of each of the raw materials of the sputtering target was changed as shown in Table 1, to thereby obtain a plurality of devices (substrates for ink jet head) and a plurality of ink jet heads. Each of the resultant devices was evaluated in the same manner as in Example A-1. The evaluated results obtained are collectively shown in Table 1. And any of the ink jet heads prepared using those devices was found to have good recording characteristics and a good durability.

Examples A-5 to A-8

A plurality of substrates and a plurality of ink jet heads were prepared by repeating the procedures of each of Examples A-1 to A-4, except that in each case, a substrate for ink jet head was firstly prepared; using the foregoing sputtering apparatus shown in FIG. 6, a 1.0 μm thick $SiO_2$ protective layer was formed on the heat generating resistor of the substrate for ink jet head by sputtering a $SiO_2$ target; followed by forming a 0.5 μm thick Ta protective layer on the $SiO_2$ protective layer by sputtering a Ta target.

Each of the resultant substrates for ink jet head and each of the resultant ink jet heads were evaluated in the same manner as in Example A-1. As a result, any of them showed an improved result in the durability test by the immersion-into-ink test (the pond test) not only in the case of low conductivity ink but also in the case of high conductivity ink in comparison with the case where no protective layer was formed. Further, with respect to resistance variation, any of them was found to be smaller than that in the case where no protective layer was formed. However, with respect to M of the SST, any of them was found to be relatively small.

From these results, it is understood that an improvement can be attained with respect to durability and occurrence of resistance variation principally due to electrochemical reaction by disposing such protective layer as above described.

As to the reason why the M of the SST was small, it is considered to be due to that the heat transfer efficiency to ink is decreased due to the protective layer and because of this, the bubble production threshold voltage ($V_{th}$) to be a denominator for the M is increased.

Comparative Examples A-1 to A-2

In each case, the procedures of Example A-1 were repeated, except that upon forming the heat generating resistor, the area ratio of each of the raw materials of the sputtering target was changed as shown in Table 1, to thereby obtain a plurality of devices (substrates for ink jet head) and a plurality of ink jet heads. Each of the resultant devices was evaluated in the same manner as in Example A-1. The evaluated results obtained are collectively shown in Table 1.

Comparative Example A-3

The procedures of Example A-1 were repeated, except that upon forming the heat generating resistor, a Cr target was used as the sputtering target, to thereby obtain a plurality of devices (substrates for ink jet head) and a plurality of ink jet heads. Each of the resultant devices was evaluated in the same manner as in Example A-1. The evaluated results obtained are collectively shown in Table 1.

Examples corresponding to the embodiment B-a

Example B-a-1

A Si single crystal base member (produced by Wacker Company) and another Si single crystal base member (produced by Wacker Company) having a 2.5 μm thick $SiO_2$ film formed on the surface thereof, respectively as the base member 603 for sputtering, were placed on the base member holder 602 situated in the film-forming chamber 601 of the foregoing high frequency sputtering apparatus shown in FIG. 6. Using a composite target comprised of a Ti target 606 of more than 99.9 wt. % in purity, and an Ir target 607 comprising an Ir sheet and a Ta target 620 respectively of around the same purity as that of the Ti target being disposed on the Ti target, sputtering was conducted under the following conditions to form an about 2000 Å thick alloy layer.

| Sputtering Conditions: | |
|---|---|
| Target area ratio | Ti:Ta:Ir = 43:37:20 |
| Target area | 5 inch (127 mm) in diameter |
| High frequency power applied | 1000 W |
| Base member temperature | 50° C. |
| Film formation period | 12 minutes |
| Base pressure | $2.6 \times 10^{-4}$ Pa or less |
| Sputtering gas pressure | 0.4 Pa (argon) |

Further, as to the base member with the $SiO_2$ film on which the alloy layer was formed, the composite target was replaced by an Al target only, followed by conducting sputtering by a conventional sputtering technique, to thereby form a 6000 Å thick Al layer to be the electrodes and 105 (see, FIG. 1) on the alloy layer.

Thereafter, photoresist was formed twice in a predetermined pattern by means of a photolithography technique. The resultant was subjected to etching treatments, wherein firstly, the Al layer was subjected to wet etching treatment, and secondly, the alloy layer was subjected to dry etching treatment by way of ion trimming, to thereby form a heat generating resistor 103 and electrodes 104 and 105 of such shapes as shown in FIG. 1(*b*) and FIG. 2(*a*). In this case, a plurality of groups each comprising 24 heat generating portions of 30 μm×170 μm in size being arranged in a raw at a pitch of 125 μm were formed on the $SiO_2$ film.

Subsequently, a $SiO_2$ film was formed over the resultant by means of a sputtering technique, followed by patterning the $SiO_2$ film using a photolithography technique and a reactive ion etching technique so as to cover over portions of 10 μm wide on the opposite sides of the heat generating portions and the electrodes, whereby forming a protective layer 106. The size of each of the heat generating portions 109 was 30 μm×150 μm.

The product in such state was cut into respective groups, to thereby obtain a plurality of substrates for ink jet head. Some of the resultants were subjected to the evaluation which will be later described. Other resultant devices (the substrates for ink jet head) were evaluated in the same manner as in Example A-1. The evaluated results obtained are collectively shown in Table 2.

As to the remaining substrates, a grooved plate 107 made of glass was joined to each of them in order to form discharging outlets 108 and liquid pathways 111 shown in FIG. 1(*a*) and FIG. 1(*b*), to thereby obtain a plurality of ink Jet heads.

Each of the ink jet heads thus obtained was set to a recording apparatus of a known constitution, and recording was performed. As a result, in any case, recording could be performed with a high discharging stability and with a high signal responsibility, wherein high quality record images were provided. And, any of the ink jet heads was found to have a good durability upon use in the apparatus.

Examples B-a-2 to B-a-6

In each case, the procedures of Example B-a-1 were repeated, except that upon forming the heat generating resistor, the area ratio of each of the raw materials of the sputtering target was changed as shown in Table 2, to thereby obtain a plurality of devices (substrates for ink jet head) and a plurality of ink jet heads. Each of the resultant devices was evaluated in the same manner as in Example B-a-1. The evaluated results obtained are collectively shown in Table 1. And any of the ink jet heads prepared using those devices was found to have good recording characteristics and a good durability.

Examples B-a-7 to B-a-12

A plurality of substrates and a plurality of ink jet heads were prepared by repeating the procedures of each of Examples B-a-1 to B-a-6, except that in each case, a substrate for ink jet head was firstly prepared; using the foregoing sputtering apparatus shown in FIG. 6, a 1.0 μm thick $SiO_2$ protective layer was formed on the heat generating resistor of the substrate for ink jet head by sputtering a $SiO_2$ target; followed by forming a 0.5 μm thick Ta protective layer on the $SiO_2$ protective layer by sputtering a Ta target.

Each of the resultant substrates for ink jet head and each of the resultant ink jet heads were evaluated in the same manner as in Example B-a-1. As a result, any of them showed an improved result in the durability test by the immersion-into-ink test (the pond test) not only in the case of low conductivity ink but also in the case of high conductivity ink in comparison with the case where no protective layer was formed. However, with respect to M of the SST, any of them was found to be relatively small.

From these results, it is understood that an improvement can be attained with respect to durability by disposing such protective layer as above described.

As to the reason why the M of the SST was small, it is considered to be due to that the heat transfer efficiency to ink is decreased due to the protective layer and because of this, the bubble production threshold voltage ($V_{th}$) to be a denominator for the M is increased.

Comparative Examples B-a-1 to B-a-2

In each case, the procedures of Example B-a-1 were repeated, except that upon forming the heat generating resistor, the area ratio of each of the raw materials of the sputtering target was changed as shown in Table 2, to thereby obtain a plurality of devices (substrates for ink jet head) and a plurality of ink jet heads. Each of the resultant devices was evaluated in the same manner as in Example B-a-1. The evaluated results obtained are collectively shown in Table 1.

Comparative Examples B-a-3 to B-a-5

In each case, the procedures of Example B-a-1 were repeated, except that upon forming the heat generating resistor, a target comprising a Ta sheet disposed on a Ti target having a different area ratio as to each of the two raw materials shown in Table 2 was used as the sputtering target, to thereby obtain a plurality of devices (substrates for ink jet head) and a plurality of ink jet heads. Each of the resultant devices was evaluated in the same manner as in Example B-a-1. The evaluated results obtained are collectively shown in Table 2.

Comparative Example B-a-6

The procedures of Example B-a-1 were repeated, except that upon forming the heat generating resistor, a target comprising an Ir sheet disposed On a Ti target having a different area ratio as to each of the two raw materials shown in Table 2 was used as the sputtering target, to thereby obtain a plurality of devices (substrates for ink Jet head) and a plurality of ink jet heads. Each of the resultant devices was evaluated in the same manner as in Example B-a-1. The evaluated results obtained are collectively shown in Table 2.

Comparative Examples B-a-7 to B-a-10

In each case, the procedures of Example B-a-1 were repeated, except that upon forming the heat generating resistor, a target comprising an Ir sheet disposed on a Ta target having a different area ratio as to each of the two raw materials shown in Table 2 was used as the sputtering target, to thereby obtain a plurality of devices (substrates for ink jet head) and a plurality of ink jet heads. Each of the resultant devices was evaluated in the same manner as in Example B-a-1. The evaluated results obtained are collectively shown in Table 2.

Comparative Example B-a-11

The procedures of Example B-a-1 were repeated, except that upon forming the heat generating resistor, a Ti target was used as the sputtering target, to thereby obtain a plurality of devices (substrates for ink jet head) and a plurality of ink jet heads. Each of the resultant devices was evaluated in the same manner as in Example B-a-1. The evaluated results obtained are collectively shown in Table 2.

Comparative Example B-a-12

The procedures of Example B-a-1 were repeated, except that upon forming the heat generating resistor, a Ta target was used as the sputtering target, to thereby obtain a plurality of devices (substrates for ink jet head) and a plurality of ink jet heads. Each of the resultant devices was evaluated in the same manner as in Example B-a-1. The evaluated results obtained are collectively shown in Table 2.

Examples corresponding to the embodiment B-b

Example B-b-1

A Si single crystal base member (produced by Wacker Company) and another Si single crystal base member (produced by Wacker Company) having a 2.5 μm thick $SiO_2$ film formed on the surface thereof, respectively as the base member 603 for sputtering, were placed on the base member holder 602 situated in the film-forming chamber 601 of the foregoing high frequency sputtering apparatus shown in FIG. 6. Using a composite target comprised of a Ta target 606 of more than 99.9 wt. % in purity, and an Ir target 607 comprising an Ir sheet and a Ru target 620 respectively of around the same purity as that of the Ta target being disposed on the Ta target, sputtering was conducted under the following conditions to form an about 2000 Å thick alloy layer.

| Sputtering Conditions: | |
|---|---|
| Target area ratio | Ta:Ru:Ir = 62:13:25 |
| Target area | 5 inch (127 mm) in diameter |
| High frequency power applied | 1000 W |
| Film formation period | 12 minutes |
| Base member temperature | 50° C. |
| Base pressure | $2.6 \times 10^{-4}$ Pa or less |
| Sputtering gas pressure | 0.4 Pa (argon) |

Further, as to the base member with the $SiO_2$ film on which the alloy layer was formed, the composite target was replaced by an Al target only, followed by conducting sputtering by a conventional sputtering technique, to thereby form a 6000 Å thick Al layer to be the electrodes 104 and 105 (see, FIG. 1) on the alloy layer.

Thereafter, photoresist was formed twice in a predetermined pattern by means of a photolithography technique. The resultant was subjected to etching treatments, wherein firstly, the Al layer was subjected to wet etching treatment, and secondly, the alloy layer was subjected to dry etching treatment by way of ion trimming, to thereby form a heat generating resistor 103 and electrodes 104 and 105 of such shapes as shown in FIG. 1(*b*) and FIG. 2(*a*). In this case, a plurality of groups each comprising 24 heat generating portions of 30 μm×170 μm in size being arranged in a raw at a pitch of 125 μm were formed on the $SiO_2$ film.

Subsequently, a $SiO_2$ film was formed over the resultant by means of a sputtering technique, followed by patterning the $SiO_2$ film using a photolithography technique and a reactive ion etching technique so as to cover over portions of 10 μm wide on the opposite sides of the heat generating portions and the electrodes, whereby forming a protective layer 106. The size of each of the heat generating portions 109 was 30 μm×150 μm.

The product in such state was cut into respective groups, to thereby obtain a plurality of substrates for ink jet head. Some of the resultants were subjected to the evaluation which will be later described. Other resultant devices (the substrates for ink jet head) were evaluated in the same manner as in Example A-1. The evaluated results obtained are collectively shown in Table 2.

As to the remaining substrates, a grooved plate 107 made of glass was joined to each of them in order to form discharging outlets 108 and liquid pathways 111 shown in FIG. 1(*a*) and FIG. 1(*b*), to thereby obtain a plurality of ink jet heads.

Each of the ink jet heads thus obtained was set to a recording apparatus of a known constitution, and recording was performed. As a result, in any case, recording could be performed with a high discharging stability and with a high signal responsibility, wherein high quality record images were provided. And, any of the ink jet heads was found to have a good durability upon use in the apparatus.

Examples B-b-2 to B-b-6

In each case, the procedures of Example B-b-1 were repeated, except that upon forming the heat generating resistor, the area ratio of each of the raw materials of the sputtering target was changed as shown in Table 3, to thereby obtain a plurality of devices (substrates for ink jet head) and a plurality of ink jet heads. Each of the resultant devices was evaluated in the same manner as in Example B-b-1. The evaluated results obtained are collectively shown in Table 3. And any of the ink jet heads prepared using those devices was found to have good recording characteristics and a good durability.

Examples B-b-7 to B-b-12

A plurality of substrates and a plurality of ink jet heads were prepared by repeating the procedures of each of Examples B-b-1 to B-b-6, except that in each case, a substrate for ink jet head was firstly prepared, using the foregoing sputtering apparatus shown in FIG. 6, a 1.0 μm thick $SiO_2$ protective layer was formed on the heat generating resistor of the substrate for ink jet head by sputtering a $SiO_2$ target, followed by forming a 0.5 μm thick Ta protective layer on the $SiO_2$ protective layer by sputtering a Ta target.

Each of the resultant substrates for ink jet head and each of the resultant ink jet heads were evaluated in the same manner as in Example B-b-1. As a result, any of them showed an improved result in the durability test by the immersion-into-ink test (the pond test) not only in the case of low conductivity ink but also in the case of high conductivity ink in comparison with the case where no protective layer was formed. However, with respect to M of the SST, any of them was found to be relatively small.

From these results, it is understood that an improvement can be attained with respect to durability by disposing such protective layer as above described.

As to the reason why the M of the SST was small, it is considered to be due to that the heat transfer efficiency to ink is decreased due to the protective layer and because of this, the bubble production threshold voltage ($V_{th}$) to be a denominator for the M is increased.

Comparative Example B-b-1

The procedures of Example B-b-1 were repeated, except that upon forming the heat generating resistor, a target comprising a Ru sheet disposed on a Ta target having an area ratio of each of the raw materials shown in Table 3 was used as the sputtering target, to thereby obtain a plurality of devices (substrates for ink Jet head) and a plurality of ink jet heads. Each of the resultant devices was evaluated in the same manner as in Example B-b-1. The evaluated results obtained are collectively shown in Table 3.

Comparative Examples B-b-2 to B-b-4

In each case, the procedures of Example B-b-1 were repeated, except that upon forming the heat generating resistor, a target comprising an Ir sheet disposed on a Ta target having a different area ratio as to each of the two raw materials shown in Table 3 was used as the sputtering target, to thereby obtain a plurality of devices (substrates for ink jet head) and a plurality of ink jet heads. Each of the resultant devices was evaluated in the same manner as in Example B-b-1. The evaluated results obtained are collectively shown in Table 3.

Comparative Example B-b-5

The procedures of Example B-b-1 were repeated, except that upon forming the heat generating resistor, a Ta target was used as the sputtering target, to thereby obtain a plurality of devices (substrates for ink jet head) and a plurality of ink jet heads. Each of the resultant devices was evaluated in the same manner as in Example B-b-1. The evaluated results obtained are collectively shown in Table 3.

Examples corresponding to the embodiment B-c

Example B-c-1

A Si single crystal base member (produced by Wacker Company) and another Si single crystal base member (produced by Wacker Company) having a 2.5 μm thick $SiO_2$ film formed on the surface thereof, respectively as the base member 603 for sputtering, were placed on the base member holder 602 situated in the film-forming chamber 601 of the foregoing high frequency sputtering apparatus shown in FIG. 6. Using a composite target comprised of a Ta target 606 of more than 99.9 wt. % in purity, and an Ir target 607 comprising an Ir sheet and an Os target 620 respectively of around the same purity as that of the Ta target being disposed on the Ta target, sputtering was conducted under the following conditions to form an about 2000 Å thick alloy layer.

| Sputtering Conditions: | |
|---|---|
| Target area ratio | Ta:Os:Ir = 43:37:20 |
| Target area | 5 inch (127 mm) in diameter |
| High frequency power applied | 1000 W |
| Base member temperature | 50° C. |
| Film formation period | 12 minutes |
| Base pressure | $2.6 \times 10^{-4}$ Pa or less |
| Sputtering gas pressure | 0.4 Pa (argon) |

Further, as to the base member with the $SiO_2$ film on which the alloy layer was formed, the composite target was replaced by an Al target only, followed by conducting sputtering by a conventional sputtering technique, to thereby form a 6000 Å thick Al layer to be the electrodes 104 and 105 (see, FIG. 1) on the alloy layer.

Thereafter, photoresist was formed twice in a predetermined pattern by means of a photolithography technique. The resultant was subjected to etching treatments, wherein firstly, the Al layer was subjected to wet etching treatment, and secondly, the alloy layer was subjected to dry etching treatment by way of ion trimming, to thereby form a heat generating resistor 103 and electrodes 104 and 105 of such shapes as shown in FIG. 1(*b*) and FIG. 2(*a*). In this case, a plurality of groups each comprising 24 heat generating portions of 30 μm×170 μm in size being arranged in a raw at a pitch of 125 μm were formed on the $SiO_2$ film.

Subsequently, a $SiO_2$ film was formed over the resultant by means of a sputtering technique, followed by patterning the $SiO_2$ film using a photolithography technique and a reactive ion etching technique so as to cover over portions of 10 μm wide on the opposite sides of the heat generating portions and the electrodes, whereby forming a protective layer 106. The size of each of the heat generating portions 109 was 30 μm×150 μm.

The product in such state was cut into respective groups, to thereby obtain a plurality of substrates for ink jet head. Some of the resultants were subjected to the evaluation which will be later described. Other resultant devices (the substrates for ink jet head) were evaluated in the same manner as in Example A-1. The evaluated results obtained are collectively shown in Table 4.

As to the remaining substrates, a grooved plate 107 made of glass was joined to each of them in order to form discharging outlets 108 and liquid pathways 111 shown in FIG. 1(*a*) and FIG. 1(*b*), to thereby obtain a plurality of ink jet heads.

Each of the ink jet heads thus obtained was set to a recording apparatus of a known constitution, and recording was performed. As a result, in any case, recording could be performed with a high discharging stability and with a high signal responsibility, wherein high quality record images were provided. And, any of the ink jet heads was found to have a good durability upon use in the apparatus.

Examples B-c-2 to B-c-5

In each case, the procedures of Example B-c-1 were repeated, except that upon forming the heat generating resistor, the area ratio of each of the raw materials of the sputtering target was changed as shown in Table 4, to thereby obtain a plurality of devices (substrates for ink jet head) and a plurality of ink jet heads. Each of the resultant devices was evaluated in the same manner as in Example B-c-1. The evaluated results obtained are collectively shown in Table 4. And any of the ink jet heads prepared using those devices was found to have good recording characteristics and a good durability.

Examples B-c-6 to B-c-10

A plurality of substrates and a plurality of ink jet heads were prepared by repeating the procedures of each of Examples B-c-1 to B-c-5, except that in each case, a substrate for ink jet head was firstly prepared; using the foregoing sputtering apparatus shown in FIG. 6, a 1.0 μm thick $SiO_2$ protective layer was formed on the heat generating resistor of the substrate for ink jet head by sputtering a $SiO_2$ target; followed by forming a 0.5 μm thick Ta protective layer on the $SiO_2$ protective layer by sputtering a Ta target.

Each of the resultant substrates for ink jet head and each of the resultant ink jet heads were evaluated in the same manner as in Example B-c-1. As a result, any of them showed an improved result in the durability test by the immersion-into-ink test (the pond test) not only in the case of low conductivity ink but also in the case of high conductivity ink in comparison with the case where no protective layer was formed. However, with respect to M of the SST, any of them was found to be relatively small.

From these results, it is understood that an improvement can be attained with respect to durability by disposing such protective layer as above described.

As to the reason why the M of the SST was small, it is considered to be due to that the heat transfer efficiency to ink is decreased due to the protective layer and because of this, the bubble production threshold voltage ($V_{th}$) to be a denominator for the M is increased.

Comparative Example B-c-1

The procedures of Example B-c-1 were repeated, except that upon forming the heat generating resistor, the area ratio of each of the raw materials of the sputtering target was changed as shown in Table 4, to thereby obtain a plurality of devices (substrates for ink jet head) and a plurality of ink jet heads. Each of the resultant devices was evaluated in the same manner as in Example B-c-1. The evaluated results obtained are collectively shown in Table 4.

Comparative Examples B-c-2 to B-c-4

In each case, the procedures of Example B-c-1 were repeated, except that upon forming the heat generating resistor, a target comprising an Os sheet disposed on a Ta target having a different area ratio as to each of the two raw materials shown in Table 4 was used as the sputtering target, to thereby obtain a plurality of devices (substrates for ink jet head) and a plurality of ink jet heads. Each of the resultant devices was evaluated in the same manner as in Example B-c-1. The evaluated results obtained are collectively shown in Table 4.

Comparative Examples B-c-5 to B-c-8

In each case, the procedures of Example B-c-1 were repeated, except that upon forming the heat generating resistor, a target comprising an Ir sheet disposed on a Ta target having a different area ratio as to each of the two raw materials shown in Table 4 was used as the sputtering target, to thereby obtain a plurality of devices (substrates for ink jet head) and a plurality of ink jet heads. Each of the resultant devices was evaluated in the same manner as in Example B-c-1. The evaluated results obtained are collectively shown in Table 4.

Comparative Example B-c-9

The procedures of Example B-c-1 were repeated, except that upon forming the heat generating resistor, a Ta target was used as the sputtering target, to thereby obtain a plurality of devices (substrates for ink jet head) and a plurality of ink jet heads. Each of the resultant devices was evaluated in the same manner as in Example B-c-1. The evaluated results obtained are collectively shown in Table 4.

Examples corresponding to the embodiment B-d

Example B-d-1

A Si single crystal base member (produced by Wacker Company) and another Si single crystal base member (produced by Wacker Company) having a 2.5 μm thick $SiO_2$ film formed on the surface thereof, respectively as the base member 603 for sputtering, were placed on the base member holder 602 situated in the film-forming chamber 601 of the foregoing high frequency sputtering apparatus shown in FIG. 6. Using a composite target comprised of a Ta target 606 of more than 99.9 wt. % in purity, and an Ir target 607 comprising an Ir sheet and a Re target 620 respectively of around the same purity as that of the Ta target being disposed on the Ta target, sputtering was conducted under the following conditions to form an about 2000 Å thick alloy layer.

| Sputtering Conditions: | |
|---|---|
| Target area ratio | Ta:Re:Ir = 25:36:39 |
| Target area | 5 inch (127 mm) in diameter |
| High frequency power applied | 1000 W |
| Film formation period | 12 minutes |
| Base member temperature | 50° C. |
| Base pressure | $2.6 \times 10^{-4}$ Pa or less |
| Sputtering gas pressure | 0.4 Pa (argon) |

Further, as to the base member with the $SiO_2$ film on which the alloy layer was formed, the composite target was replaced by an Al target only, followed by conducting sputtering by a conventional sputtering technique, to thereby form a 6000 Å thick Al layer to be the electrodes 104 and 105 (see, FIG. 1) on the alloy layer.

Thereafter, photoresist was formed twice in a predetermined pattern by means of a photolithography technique. The resultant was subjected to etching treatments, wherein firstly, the Al layer was subjected to wet etching treatment, and secondly, the alloy layer was subjected to dry etching treatment by way of ion trimming, to thereby form a heat generating resistor 103 and electrodes 104 and 105 of such shapes as shown in FIG. 1(*b*) and FIG. 2(*a*). In this case, a plurality of groups each comprising 24 heat generating portions of 30 μm×170 μm in size being arranged in a raw at a pitch of 125 μm were formed on the $SiO_2$ film.

Subsequently, a $SiO_2$ film was formed over the resultant by means of a sputtering technique, followed by patterning the $SiO_2$ film using a photolithography technique and a reactive ion etching technique so as to cover over portions of 10 μm wide on the opposite sides of the heat generating portions and the electrodes, whereby forming a protective layer 106. The size of each of the heat generating portions 109 was 30 μm×150 μm.

The product in such state was cut into respective groups, to thereby obtain a plurality of substrates for ink jet head. Some of the resultants were subjected to the evaluation which will be later described. Other resultant devices (the substrates for ink jet head) were evaluated in the same manner as in Example A-1. The evaluated results obtained are collectively shown in Table 5.

As to the remaining substrates, a grooved plate 107 made of glass was joined to each of them in order to form discharging outlets 108 and liquid pathways 111 shown in FIG. 1(*a*) and FIG. 1(*b*), to thereby obtain a plurality of ink jet heads.

Each of the ink jet heads thus obtained was set to a recording apparatus of a known constitution, and recording was performed. As a result, in any case, recording could be performed with a high discharging stability and with a high signal responsibility, wherein high quality record images were provided. And, any of the ink jet heads was found to have a good durability upon use in the apparatus.

Examples B-d-2 to B-d-5

In each case, the procedures of Example B-d-1 were repeated, except that upon forming the heat generating resistor, the area ratio of each of the raw materials of the sputtering target was changed as shown in Table 5, to thereby obtain a plurality of devices (substrates for ink jet head) and a plurality of ink jet heads. Each of the resultant devices was evaluated in the same manner as in Example B-d-1. The evaluated results obtained are collectively shown in Table 5. And any of the ink jet heads prepared using those devices was found to have good recording characteristics and a good durability.

Examples B-d-6 to B-d-10

A plurality of substrates and a plurality of ink jet heads were prepared by repeating the procedures of each of Examples B-d-1 to B-d-5, except that in each case, a substrate for ink jet head was firstly prepared; using the foregoing sputtering apparatus shown in FIG. 6, a 1.0 μm thick $SiO_2$ protective layer was formed on the heat generating resistor of the substrate for ink jet head by sputtering a $SiO_2$ target; followed by forming a 0.5 μm thick Ta protective layer on the $SiO_2$ protective layer by sputtering a Ta target.

Each of the resultant substrates for ink jet head and each of the resultant ink jet heads were evaluated in the same manner as in Example B-d-1. As a result, any of them showed an improved result in the durability test by the immersion-into-ink test (the pond test) not only in the case of low conductivity ink but also in the case of high conductivity ink in comparison with the case where no protective layer was formed. However, with respect to M of the SST, any of them was found to be relatively small.

From these results, it is understood that an improvement can be attained with respect to durability by disposing such protective layer as above described.

As to the reason why the M of the SST was small, it is considered to be due to that the heat transfer efficiency to ink is decreased due to the protective layer and because of this, the bubble production threshold voltage ($V_{th}$)to be a denominator for the M is increased.

Comparative Examples B-d-1 to B-d-3

In each case, the procedures of Example B-d-1 were repeated, except that upon forming the heat generating resistor, the area ratio of each of the raw materials of the sputtering target was changed as shown in Table 5, to thereby obtain a plurality of devices (substrates for ink jet head) and a plurality of ink jet heads. Each of the resultant devices was evaluated in the same manner as in Example B-d-1. The evaluated results obtained are collectively shown in Table 5.

Comparative Example B-d-4

The procedures of Example B-d-1 were repeated, except that upon forming the heat generating resistor, a target comprising a Re sheet disposed on a Ta target having a different area ratio as to each of the two raw materials shown in Table 5 was used as the sputtering target, to thereby obtain a plurality of devices (substrates for ink jet head) and a plurality of ink jet heads. Each of the resultant devices was evaluated in the same manner as in Example B-d-1. The evaluated results obtained are collectively shown in Table 5.

Comparative Examples B-d-5 to B-d-8

In each case, the procedures of Example B-d-1 were repeated, except that upon forming the heat generating resistor, a target comprising an Ir sheet disposed on a Ta target having a different area ratio as to each of the two raw materials shown in Table 5 was used as the sputtering target, to thereby obtain a plurality of devices (substrates for ink jet head) and a plurality of ink jet heads. Each of the resultant devices was evaluated in the same manner as in Example B-d-1. The evaluated results obtained are collectively shown in Table 5.

Comparative Example B-d-9

The procedures of Example B-d-1 were repeated, except that upon forming the heat generating resistor, a Ta target was used as the sputtering target, to thereby obtain a plurality of devices (substrates for ink jet head) and a plurality of ink jet heads. Each of the resultant devices was evaluated in the same manner as in Example B-d-1. The evaluated results obtained are collectively shown in Table 5.

Examples corresponding to the embodiment C

Example C-1

A Si single crystal base member (produced by Wacker Company) and another Si single crystal base member (produced by Wacker Company) having a 2.5 μm thick $SiO_2$ film formed on the surface thereof, respectively as the base member 603 for sputtering, were placed on the base member holder 602 situated in the film-forming chamber 601 of the foregoing high frequency sputtering apparatus shown in FIG. 6. Using a composite target comprised of an Al target 606 of more than 99.9 wt. % in purity, and an Ir target 607 comprising an Ir sheet and a Y target 620 respectively of around the same purity as that of the Ta target, being disposed on the Ta target, sputtering was conducted under the following conditions to form an about 2000 Å thick alloy layer.

| Sputtering Conditions: | |
|---|---|
| Target area ratio | Al:Y:Ir = 25:10:65 |
| Target area | 5 inch (127 mm) in diameter |
| High frequency power applied | 1000 W |
| Base member temperature | 50° C. |
| Film formation period | 12 minutes |
| Base pressure | $2.6 \times 10^{-4}$ Pa or less |
| Sputtering gas pressure | 0.4 Pa (argon) |

Further, as to the base member with the $SiO_2$ film on which the alloy layer was formed, the composite target was replaced by an Al target only, followed by conducting sputtering by a conventional sputtering technique, to thereby form a 6000 Å thick Al layer to be the electrodes 104 and 105 (see, FIG. 1) on the alloy layer.

Thereafter, photoresist was formed twice in a predetermined pattern by means of a photolithography technique. The resultant was subjected to etching treatments, wherein firstly, the Al layer was subjected to wet etching treatment, and secondly, the alloy layer was subjected to dry etching treatment by way of ion trimming, to thereby form a heat generating resistor 103 and electrodes 104 and 105 of such shapes as shown in FIG. 1(*b*) and FIG. 2(*a*). In this case, a plurality of groups each comprising 24 heat generating portions of 30 μm×170 μm in size being arranged in a raw at a pitch of 125 μm were formed on the base member with the $SiO_2$ film.

Subsequently, a $SiO_2$ film was formed over the resultant by means of a sputtering technique, followed by patterning the $SiO_2$ film using a photolithography technique and a reactive ion etching technique so as to cover over portions of 10 μm wide on the opposite sides of the heat generating portions and the electrodes, whereby forming a protective layer 106. The size of each of the heat generating portions 109 was 30 μm×150 μm.

The product in such state was cut into respective groups, to thereby obtain a plurality of substrates for ink jet head. Some of the resultants were subjected to the evaluation which will be later described. Other resultant devices (the substrates for ink jet head) were evaluated in the same manner as in Example A-1. The evaluated results obtained are collectively shown in Table 6.

As to the remaining substrates, a grooved plate 107 made of glass was joined to each of them in order to form discharging outlets 108 and liquid pathways 111 shown in FIG. 1(*a*) and FIG. 1(*b*), to thereby obtain a plurality of ink jet heads.

Each of the ink jet heads thus obtained was set to a recording apparatus of a known constitution, and recording was performed. As a result, in any case, recording could be performed with a high discharging stability and with a high signal responsibility, wherein high quality record images were provided. And, any of the ink jet heads was found to have a good durability upon use in the apparatus.

Examples C-2 to C-5

In each case, the procedures of Example C-1 were repeated, except that upon forming the heat generating resistor, the area ratio of each of the raw materials of the sputtering target was changed as shown in Table 6, to thereby obtain a plurality of devices (substrates for ink jet head) and a plurality of ink jet heads. Each of the resultant devices was evaluated in the same manner as in Example C-1. The evaluated results obtained are collectively shown in Table 6. And any of the ink jet heads prepared using those devices was found to have good recording characteristics and a good durability.

Examples C-6 to C-10

A plurality of substrates and a plurality of ink jet heads were prepared by repeating the procedures of each of Examples C-1 to C-5, except that in each case, a substrate for ink jet head was firstly prepared; using the foregoing sputtering apparatus shown in FIG. 6, a 1.0 μm thick $SiO_2$ protective layer was formed on the heat generating resistor of the substrate for ink jet head by sputtering a $SiO_2$ target; followed by forming a 0.5 μm thick Ta protective layer on the $SiO_2$ protective layer by sputtering a Ta target.

Each of the resultant substrates for ink jet head and each of the resultant ink jet heads were evaluated in the same manner as in Example C-1. As a result, any of them showed an improved result in the durability test by the immersion-into-ink test (the pond test) not only in the case of low conductivity ink but also in the case of high conductivity ink in comparison with the case where no protective layer was formed. However, with respect to M of the SST, any of them was found to be relatively small.

From these results, it is understood that an improvement can be attained with respect to durability by disposing such protective layer as above described.

As to the reason why the M of the SST was small, it is considered to be due to that the heat transfer efficiency to ink is decreased due to the protective layer and because of this, the bubble production threshold voltage ($V_{th}$) to be a denominator for the M is increased.

Comparative Examples C-1 to C-4

In each case, the procedures of Example C-1 were repeated, except that upon forming the heat generating resistor, the area ratio of each of the raw materials of the sputtering target was changed as shown in Table 6, to thereby obtain a plurality of devices (substrates for ink jet head) and a plurality of ink jet heads. Each of the resultant devices was evaluated in the same manner as in Example C-1. The evaluated results obtained are collectively shown in Table 6.

Comparative Examples C-5 to C-10

In each case, the procedures of Example C-1 were repeated, except that upon forming the heat generating resistor, a target comprising an Ir sheet disposed on an Al target having a different area ratio as to each of the two raw materials shown in Table 6 was used as the sputtering target, to thereby obtain a plurality of devices (substrates for ink jet head) and a plurality of ink jet heads. Each of the resultant devices was evaluated in the same manner as in Example C-1. The evaluated results obtained are collectively shown in Table 6.

Examples corresponding to the embodiment D

Example D-1

A Si single crystal base member (produced by Wacker Company) and another Si single crystal base member (produced by Wacker Company) having a 2.5 μm thick $SiO_2$ film formed on the surface thereof, respectively as the base member 603 for sputtering, were placed on the base member holder 602 situated in the film-forming chamber 601 of the foregoing high frequency sputtering apparatus shown in FIG. 6. Using a composite target comprised of an CR target 606 of more than 99.9 wt. % in purity, and an Ir target 607 comprising an Ir sheet and a Ru target 620 respectively of around the same purity as that of the CR target being disposed on the CR target, sputtering was conducted under the following conditions to form an about 2000 Å thick alloy layer.

| Sputtering Conditions: | |
|---|---|
| Target area ratio | Cr:Ru:Ir = 31:35:35 |
| Target area | 5 inch (127 mm) in diameter |
| High frequency power applied | 1000 W |
| Film formation period | 12 minutes |
| Base member temperature | 50° C. |
| Base pressure | $2.6 \times 10^{-4}$ Pa or less |
| Sputtering gas pressure | 0.4 Pa (argon) |

Further, as to the base member with the $SiO_2$ film on which the alloy layer was formed, the composite target was replaced by an Al target only, followed by conducting sputtering by a conventional sputtering technique, to thereby form a 6000 Å thick Al layer to be the electrodes 104 and 105 (see, FIG. 1) on the alloy layer.

Thereafter, photoresist was formed twice in a predetermined pattern by means of a photolithography technique. The resultant was subjected to etching treatments, wherein firstly, the Al layer was subjected to wet etching treatment, and secondly, the alloy layer was subjected to dry etching treatment by way of ion trimming, to thereby form a heat generating resistor 103 and electrodes 104 and 105 of such shapes as shown in FIG. 1(*b*) and FIG. 2(*a*). In this case, a plurality of groups each comprising 24 heat generating portions of 30 μm×170 μm in size being arranged in a raw at a pitch of 125 μm were formed on the base member with the $SiO_2$ film.

Subsequently, a $SiO_2$ film was formed over the resultant by means of a sputtering technique, followed by patterning the $SiO_2$ film using a photolithography technique and a reactive ion etching technique so as to cover over portions of 10 μm wide on the opposite sides of the heat generating portions and the electrodes, whereby forming a protective layer 106. The size of each of the heat generating portions 109 was 30 μm×150 μm.

The product in such state was cut into respective groups, to thereby obtain a plurality of substrates for ink jet head. Some of the resultants were subjected to the evaluation which will be later described. Other resultant devices (the substrates for ink jet head) were evaluated in the same manner as in Example A-1. The evaluated results obtained are collectively shown in Table 7.

As to the remaining substrates, a grooved plate 107 made of glass was joined to each of them in order to form discharging outlets 108 and liquid pathways 111 shown in FIG. 1(*a*) and FIG. 1(*b*), to thereby obtain a plurality of ink jet heads.

Each of the ink jet heads thus obtained was set to a recording apparatus of a known constitution, and recording was performed. As a result, in any case, recording could be performed with a high discharging stability and with a high signal responsibility, wherein high quality record images were provided. And, any of the ink jet heads was found to have a good durability upon use in the apparatus.

Examples D-2 to D-5

In each case, the procedures of Example D-1 were repeated, except that upon forming the heat generating resistor, the area ratio of each of the raw materials of the sputtering target was changed variously as shown in Table 7, to thereby obtain a plurality of devices (substrates for ink jet head) and a plurality of ink jet heads. Each of the resultant devices was evaluated in the same manner as in Example D-1. The evaluated results obtained are collectively shown in Table 7. And any of the ink jet heads prepared using those devices was found to have good recording characteristics and a good durability.

Examples D-6 to D-10

A plurality of substrates and a plurality of ink jet heads were prepared by repeating the procedures of each of Examples D-1 to D-5, except that in each case, a substrate for ink jet head was firstly prepared; using the foregoing sputtering apparatus shown in FIG. 6, a 1.0 μm thick $SiO_2$ protective layer was formed on the heat generating resistor of the substrate for ink jet head by sputtering a $SiO_2$ target; followed by forming a 0.5 μm thick Ta protective layer on the $SiO_2$ protective layer by sputtering a Ta target.

Each of the resultant substrates for ink jet head and each of the resultant ink jet heads were evaluated in the same manner as in Example D-1. As a result, any of them showed an improved result in the durability test by the immersion-into-ink test (the pond test) not only in the case of low conductivity ink but also in the case of high conductivity ink in comparison with the case where no protective layer was formed. However, with respect to M of the SST, any of them was found to be relatively small.

From these results, it is understood that an improvement can be attained with respect to durability by disposing such protective layer as above described.

As to the reason why the M of the SST was small, it is considered to be due to that the heat transfer efficiency to ink is decreased due to the protective layer and because of this, the bubble production threshold voltage ($V_{th}$)to be a denominator for the M is increased.

Comparative Example D-1

The procedures of Example D-1 were repeated, except that upon forming the heat generating resistor, a target comprising a Ru sheet disposed on a Cr target having a different area ratio as to each of the two raw materials shown in Table 7 was used as the sputtering target, to thereby obtain a plurality of devices (substrates for ink jet head) and a plurality of ink jet heads. Each of the resultant devices was evaluated in the same manner as in Example D-1. The evaluated results obtained are collectively shown in Table 7.

Comparative Example D-2

The procedures of Example D-1 were repeated, except that upon forming the heat generating resistor, a target comprising an Ir sheet disposed on a Cr target having a different area ratio as to each of the two raw materials shown in Table 7 was used as the sputtering target, to thereby obtain a plurality of devices (substrates for ink jet head) and a plurality of ink jet heads. Each of the resultant devices was evaluated in the same manner as in Example D-1. The evaluated results obtained are collectively shown in Table 7.

Comparative Example D-3

The procedures of Example D-1 were repeated, except that upon forming the heat generating resistor, a Cr target was used as the sputtering target, to thereby obtain a plurality of devices (substrates for ink jet head) and a plurality of ink jet heads. Each of the resultant devices was evaluated in the same manner as in Example D-1. The evaluated results obtained are collectively shown in Table 7.

Examples corresponding to the embodiment E

Example E-1

A Si single crystal base member (produced by Wacker Company) and another Si single crystal base member (produced by Wacker Company) having a 2.5 μm thick $SiO_2$ film formed on the surface thereof, respectively as the base member 603 for sputtering, were placed on the base member holder 602 situated in the film-forming chamber 601 of the foregoing high frequency sputtering apparatus shown in FIG. 6. Using a composite target comprised of a Ta target 606 of more than 99.9 wt. % in purity, and two Pt targets 607 respectively comprising a Pt sheet of around the same purity as that of the Ta target being disposed on the Ta target, sputtering was conducted under the following conditions to form an about 2000 Å thick alloy layer.

| Sputtering Conditions: | |
|---|---|
| Target area ratio | Ta:Pt = 28:72 |
| Target area | 5 inch (127 mm) in diameter |
| High frequency power applied | 1000 W |
| Film formation period | 12 minutes |
| Base member temperature | 50° C. |
| Base pressure | $2.6 \times 10^{-4}$ Pa or less |
| Sputtering gas pressure | 0.4 Pa (argon) |

Further, as to the base member with the $SiO_2$ film on which the alloy layer was formed, the composite target was replaced by an Al target only, followed by conducting sputtering by a conventional sputtering technique, to thereby form a 6000 Å thick Al layer to be the electrodes 104 and 105 (see, FIG. 1) on the alloy layer.

Thereafter, photoresist was formed twice in a predetermined pattern by means of a photolithography technique. The resultant was subjected to etching treatments, wherein firstly, the Al layer was subjected to wet etching treatment, and secondly, the alloy layer was subjected to dry etching treatment by way of ion trimming, to thereby form a heat generating resistor 103 and electrodes 104 and 105 of such shapes as shown in FIG. 1(*b*) and FIG. 2(*a*). In this case, a plurality of groups each comprising 24 heat generating portions of 30 μm×170 μm in size being arranged in a raw at a pitch of 125 μm were formed on the base member with the $SiO_2$ film.

Subsequently, a $SiO_2$ film was formed over the resultant by means of a sputtering technique, followed by patterning the $SiO_2$ film using a photolithography technique and a reactive ion etching technique so as to cover over portions of 10 μm wide on the opposite sides of the heat generating portions and the electrodes, whereby forming a protective layer 106. The size of each of the heat generating portions 109 was 30 μm×150 μm.

The product in such state was cut into respective groups, to thereby obtain a plurality of substrates for ink jet head. Some of the resultants were subjected to the evaluation which will be later described. Other resultant devices (the substrates for ink jet head) were evaluated in the same manner as in Example A-1. The evaluated results obtained are collectively shown in Table 8.

As to the remaining substrates, a grooved plate 107 made of glass was joined to each of them in order to form discharging outlets 108 and liquid pathways 111 shown in FIG. 1(*a*) and FIG. 1(*b*), to thereby obtain a plurality of ink jet heads.

Each of the ink jet heads thus obtained was set to a recording apparatus of a known constitution, and recording was performed. As a result, in any case, recording could be performed with a high discharging stability and with a high signal responsibility, wherein high quality record images were provided. And, any of the ink jet heads was found to have a good durability upon use in the apparatus.

Examples E-2 to E-3

In each case, the procedures of Example E-1 were repeated, except that upon forming the heat generating resistor, the area ratio of each of the raw materials of the sputtering target was changed variously as shown in Table 8, to thereby obtain a plurality of devices (substrates for ink jet head) and a plurality of ink jet heads. Each of the resultant devices was evaluated in the same manner as in Example E-1. The evaluated results obtained are collectively shown in Table 8. And any of the ink jet heads prepared using those devices was found to have good recording characteristics and a good durability.

Examples E-4 to E-6

A plurality of substrates and a plurality of ink jet heads were prepared by repeating the procedures of each of Examples E-1 to E-3, except that in each case, a substrate for ink jet head was firstly prepared; using the foregoing sputtering apparatus shown in FIG. 6, a 1.0 μm thick $SiO_2$ protective layer was formed on the heat generating resistor of the substrate for ink jet head by sputtering a $SiO_2$ target; followed by forming a 0.5 μm thick Ta protective layer on the $SiO_2$ protective layer by sputtering a Ta target.

Each of the resultant substrates for ink jet head and each of the resultant ink jet heads were evaluated in the same manner as in Example E-1. As a result, any of them showed an improved result in the durability test by the immersion-into-ink test (the pond test) not only in the case of low conductivity ink but also in the case of high conductivity ink in comparison with the case where no protective layer was formed. Further, with respect to resistance variation, any of them was found to be smaller than that in the case where no protective layer was formed. However, with respect to M of the SST, any of them was found to be relatively small.

From these results, it is understood that an improvement can be attained with respect to durability and resistance variation mainly due to electrochemical reaction by disposing such protective layer as above described.

As to the reason why the M of the SST was small, it is considered to be due to that the heat transfer efficiency to ink is decreased due to the protective layer and because of this, the bubble production threshold voltage ($V_{th}$)to be a denominator for the M is increased.

Comparative Examples E-1 to E-3

In each case, the procedures of Example E-1 were repeated, except that upon forming the heat generating resistor, the area ratio of each of the raw materials of the sputtering target was changed variously as shown in Table 8, to thereby obtain a plurality of devices (substrates for ink jet head) and a plurality of ink jet heads. Each of the resultant devices was evaluated in the same manner as in Example E-1. The evaluated results obtained are collectively shown in Table 8.

Comparative Example E-4

The procedures of Example E-1 were repeated, except that upon forming the heat generating resistor, a Pt target was used as the sputtering target, to thereby obtain a plurality of devices (substrates for ink jet head) and a plurality of ink jet heads. Each of the resultant devices was evaluated in the same manner as in Example E-1. The evaluated results obtained are collectively shown in Table 8.

Comparative Example E-5

The procedures of Example E-1 were repeated, except that upon forming the heat generating resistor, a Ta target was used as the sputtering target, to thereby obtain a plurality of devices (substrates for ink jet head) and a plurality of ink jet heads. Each of the resultant devices was evaluated in the same manner as in Example E-1. The evaluated results obtained are collectively shown in Table 8.

Additional Comparative Examples

Following the procedures of the foregoing examples corresponding to the embodiments A to E, there were prepared a plurality of substrates for ink jet head and a plurality of ink jet heads, wherein their heat generating resistors were formed using the materials described in Literatures 1 and 2.

Each of the resultant substrates for ink jet head and each of the resultant ink jet heads were evaluated in the same manner as in Example A-1. As a result, any of them was found to be inferior to any of those obtained in the foregoing examples corresponding to the embodiments A to E not only with respect to bubble endurance in the immersion-into-ink test (the pond test) in both the case of low conductivity ink and in the case of high conductivity ink but also with respect to M of the SST. Particularly, it was found that the durability found in the examples of the present invention is surpassing that found in the additional examples by about 1.2 times.

From these results, it is understood that in the case of conducting driving with a relatively long drive pulse duration, the substrates for ink jet head and the ink jet heads obtained in the foregoing examples of the present invention are surpassing those in which their heat generating resistors are comprised of the materials described in Literatures 1 and 2 especially with respect to durability.

Now, the present invention can be properly applied in recording heads or recording apparatus provided with an ink jet recording system of discharging ink using an electric and mechanical converting body or the like such as piezo elements. However, the present invention provides a pronounced effect when applied in recording heads or recording apparatus provided with a ink jet recording system of discharging ink utilizing heat energy.

A representative structure or principle of the recording head and recording apparatus of the present invention are preferably those that adopt such a fundamental principle as disclosed, for example, in U.S. Pat. No. 4,723,129 or U.S. Pat. No. 4,740,796. While this system can be applied to either the so-called on demand type or the continuous type, it is particularly effective when applied to the on-demand type because, by applying at least one driving signal for providing a rapid temperature rise exceeding nucleate boiling in response to recording information to an electrothermal converting body arranged for a sheet on which liquid (ink) is carried or for a liquid pathway, the electrothermal converting body is actuated to generate heat energy resulting in causing film boiling at ink on a heat acting face of the recording head and as a result, a bubble is formed in the liquid (the ink) in a one by one corresponding to such driving signal. By the growth and contraction of such bubble, the liquid (the ink) is discharged through a discharging outlet to form at least one droplet. If the driving signal has a pulse shape, growth and contraction of a bubble take place promptly and appropriately, and consequently, discharging of the liquid (the ink) which is superior particularly in responsibility can be achieved, which is further desirable. As the driving signal of such pulse shape, such a driving signal as disclosed in U.S. Pat. No. 4,463,359 or U.S. Pat. No. 4,345,262 is suitable. Further improved recording can be attained when such conditions as described in U.S. Pat. No. 4,313,124 of the invention relating to the rate of temperature rise of the heat acting face are adopted.

As the constitution of the recording head, in addition to those combinations of the discharging outlet, liquid pathway and electrothermal converting body (linear liquid flow pathway or perpendicular liquid flow pathway) disclosed in the foregoing patent documents, constitutions based on the constitution with a heat acting portion disposed in a curved region disclosed in U.S. Pat. No. 4,558,333 or U.S. Pat. No. 4,459,600 are also included in the present invention. In addition, the present invention is also effective for a constitution based on Japanese Patent Laid-open No. 123670/1984 which discloses a constitution wherein a slit common to a plurality of electrothermal converting bodies is used as a discharging portion of the electrothermal converting bodies or for other constitution based on Japanese Patent Laid-open No. 138461/1984 which discloses a constitution wherein an opening for absorbing pressure wave of heat energy is made to correspond to a discharging portion.

Further, as the recording head of the full line type having a length corresponding to the width of a maximum record medium on which record can be made by the recording apparatus, a constitution which enables to complete the length by the combined use of those recording heads disclosed in the foregoing patent documents or other constitution comprising a single recording head integrally formed in the form of a single body may be employed, and in any of these cases, the present invention exhibits the foregoing effects further effectively.

Further in addition, the present invention is also effective in the case of a recording head of the exchangeable chip type wherein electric connection to an apparatus body or supply of ink from the apparatus body is enabled by mounting it to the apparatus body or in the case of a recording head of the cartridge type wherein an ink tank is provided integrally on the recording head itself.

It is desirable to add restoring means for a recording head or preparatory auxiliary means or the like as one of the constituents of the recording apparatus of the present invention. By this, the effects of the present invention can be stabilized further. Particularly, capping means, cleaning means, pressurizing or attracting means, preliminary heating means including an electrothermal converting body or a separate heating element or a combination of them, and to employ a preparatory discharging mode in which discharging is performed separately from recording, are effective to achieve stable recording.

Further, as for the recording mode of a recording apparatus, the present invention is very effective not only for a recording apparatus which has a recording mode of a main color such as black but also for a recording apparatus, which may be structured to have an integral recording head or to comprise a combination of a plurality of recording heads, which has a recording mode of a plurality of different colors or full colors by way of color mixture.

While the foregoing examples of the present invention are described using liquid ink, in the present invention, there can be used such ink that is in solid state at normal temperature or that is softened at normal temperature. The foregoing ink jet apparatus commonly effect temperature control such that the temperature of the ink itself is adjusted to be in the range of from 30° C. to 70° C. in order to maintain the viscosity of the ink within a stable discharging range. Because of this, in the ink jet apparatus, any ink can be used as long as the ink is in liquid state when a recording signal is applied thereto. In the present invention, as for the ink used, due care should be made so that a rise of temperature at the head is not caused by heat energy which is positively used for the transformation of the ink from a solid state to a liquid state or the ink is solidified in a left condition without being evaporated. In view of this, it is possible to use those inks having a property capable of being liquefied by the action of heat energy such as inks capable of being liquefied and discharged in liquid state upon the application of heat energy in response to a recording signal and inks capable of being solidified upon arriving at a record medium. These inks may be used in such a manner as disclosed in Japanese Patent Laid-open No. 56847/1979 or Japanese Patent Laid-open No. 71260/1985 wherein the ink is opposed to an electrothermal converting body in a condition wherein it is held as a liquid or solid substance in recessed portions of a porous sheet or through-holes. In the present invention, the foregoing film boiling method is the most effective for discharging the above inks.

As above detailed, according to the present invention, by constituting the heat generating resistor by a non-single crystalline material composed of Ir and other one specific element at the respective specific composition rates or a non-single crystalline material composed of Ir and other two specific elements at the respective specific composition rates, there is provided an improved ink jet head which excels in resistance to cavitation shock, resistance to erosion by cavitation, mechanical durability, chemical stability, electrochemical stability, inherent resistance stability, heat resistance, oxidation resistance, dissolution resistance and resistance to thermal shock.

In addition, according to the present invention, there is provided an improved ink jet head in which heat energy is always stably transmitted at a high efficiency to recording liquid (ink) in response to a signal on demand to effect ink discharging whereby providing excellent recorded images, even after repetitive use over a long period of time.

Further, according to the present invention, there is provided an improved ink jet head having a structure excelling in heat transfer wherein a heat generating resistor is disposed so as to directly contact with recording liquid and in which the power consumption by the heat generating resistor is restricted low to minimize the temperature variation of the ink jet head and, even after repetitive use over a long period of time, ink discharging is always stably effected to provide recorded images which are free of a variation in density caused by a variation in temperature of the ink jet head.

Further in addition, according to the present invention, there is provided an ink jet head provided with a heat generating resistor constituted by a material with full advantage of the merits of Ir liable to exhibit superiority especially in terms of heat resistance, oxidation resistance and chemical stability, which exhibits a sufficient durability, even in the case of driving the ink jet head with a relatively long drive pulse duration.

Furthermore, according to the present invention, there is provided an improved substrate for ink jet head which serves to constitute the above ink jet head and an improved ink jet apparatus provided with the above ink jet head.

TABLE 1

| | target area ratio | | film composition (atomic %) | | film thickness | | specific resistance | density | internal stress |
|---|---|---|---|---|---|---|---|---|---|
| | Cr | Ir | Cr | Ir | (Å) | crystallinity | (μΩcm) | (g/cm³) | (kgf/mm²) |

TABLE 1-continued

| | | | | | | | | | | |
|---|---|---|---|---|---|---|---|---|---|---|
| Example | A-1 | 61 | 39 | 32 | 68 | 3375 | C | 75 | 15.0 | −146 |
| | A-2 | 68 | 32 | 46 | 54 | 3310 | C | 82 | 13.2 | −95 |
| | A-3 | 76 | 24 | 60 | 40 | 3220 | C | 99 | 11.7 | −57 |
| | A-4 | 87 | 13 | 76 | 24 | 3470 | C | 93 | 9.1 | −12 |
| Comparative | A-1 | 44 | 55 | 19 | 81 | 3278 | C | 55 | 17.2 | — |
| Example | A-2 | 95 | 5 | 89 | 11 | 3650 | C | 52 | 6.5 | +110 |
| | A-3 | 100 | | 100 | | 3900 | C | 50 | 5.2 | +300 |

| | | pond test | | resistance variation | SST | | BJ aptitude | | |
|---|---|---|---|---|---|---|---|---|---|
| | | clear | black | % | M | temperature (°C.) | print quality | durability | total evaluation |
| Example | A-1 | 25 | 10.0 | 2.3 | 1.85 | 1030 | o | o | o |
| | A-2 | 17 | 8.0 | 2.2 | 1.82 | 990 | o | o | o |
| | A-3 | 12 | 5.5 | 2.1 | 1.80 | 970 | o | o | o |
| | A-4 | 15 | 6.0 | 1.7 | 1.74 | 910 | o | o | o |
| Comparative | A-1 | 5 | 2.5 | 0.4 | 1.50 | 680 | Δ | x | x |
| Example | A-2 | 2.0 | 1.0 | 0.2 | 1.23 | 470 | x | x | x |
| | A-3 | 0.0 | 0.0 | — | 1.10 | 360 | x | x | x |

—: impossible to measure

TABLE 2

| | | target area ratio | | | film composition (atomic %) | | | film thickness | | specific resistance | density | internal stress |
|---|---|---|---|---|---|---|---|---|---|---|---|---|
| | | Ti | Ta | Ir | Ti | Ta | Ir | (Å) | crystallinity | (μΩcm) | (g/cm³) | (kgf/mm²) |
| Example | B-a-1 | 43 | 37 | 20 | 11 | 43 | 46 | 2158 | A | 206 | 16.7 | −8 |
| | B-a-2 | 53 | 27 | 20 | 22 | 28 | 50 | 2581 | C | 215 | 14.0 | −15 |
| | B-a-3 | 48 | 24 | 28 | 16 | 26 | 59 | 2719 | C | 227 | 14.8 | −13 |
| | B-a-4 | 39 | 20 | 41 | 14 | 18 | 68 | 2788 | C | 232 | 16.6 | −150 |
| | B-a-5 | 30 | 15 | 55 | 10 | 12 | 78 | 2810 | C | 230 | 17.1 | −157 |
| | B-a-6 | 65 | 7 | 28 | 38 | 5 | 57 | 2520 | C | 212 | 13.8 | −12 |
| Comparative | B-a-1 | 53 | 37 | 10 | 30 | 47 | 23 | 2243 | A | 170 | 12.5 | −68 |
| Example | B-a-2 | 43 | 47 | 10 | 12 | 59 | 29 | 2307 | A | 138 | 13.1 | −39 |
| | B-a-3 | 35 | 65 | | 13 | 87 | | 2187 | C | 172 | 13.1 | −107 |
| | B-a-4 | 58 | 42 | | 34 | 66 | | 2500 | C | 68 | 10.0 | −73 |
| | B-a-5 | 80 | 20 | | 63 | 37 | | 2340 | C | 101 | 6.9 | −26 |
| | B-a-6 | 87 | | 13 | 56 | | 44 | 2382 | A | 228 | 8.6 | −24 |
| | B-a-7 | | 94 | 6 | | 94 | 6 | 2110 | C | 171 | 15.1 | −157 |
| | B-a-8 | | 86 | 14 | | 67 | 33 | 2320 | A | 198 | 16.8 | −58 |
| | B-a-9 | | 46 | 54 | | 21 | 79 | 2890 | C | 121 | 19.0 | −238 |
| | B-a-10 | | 37 | 63 | | 12 | 88 | 3020 | C | 78 | 19.0 | −210 |
| | B-a-11 | 100 | | | 100 | | | 1330 | C | 78 | 4.7 | +100 |
| | B-a-12 | | 100 | | | 100 | | 2080 | C | 181 | 14.3 | −136 |

| | | pond test | | resistance variation | SST | | BJ aptitude | | |
|---|---|---|---|---|---|---|---|---|---|
| | | clear | black | % | M | temperature (°C.) | print quality | durability | total evaluation |
| Example | B-a-1 | 12.0 | 5.0 | 4.4 | 1.56 | 730 | o | o | o |
| | B-a-2 | 19 | 5.2 | 4.3 | 1.50 | 700 | o | o | o |
| | B-a-3 | 21 | 6.7 | 3.6 | 1.53 | 750 | o | o | o |
| | B-a-4 | 30 | 9.8 | 2.3 | 1.55 | 720 | o | o | o |
| | B-a-5 | 25 | 8.0 | 3.2 | 1.53 | 750 | o | o | o |
| | B-a-6 | 13 | 6.2 | 3.8 | 1.53 | 750 | o | o | o |
| Comparative | B-a-1 | 4.0 | 2.0 | 5.4 | 1.25 | 470 | Δ | x | x |
| Example | B-a-2 | 7.2 | 2.3 | 5.1 | 1.28 | 490 | x | x | x |
| | B-a-3 | 0.9 | 0.2 | 7.2 | 1.20 | 430 | x | x | x |
| | B-a-4 | 1.2 | 0.6 | 9.3 | 1.15 | 400 | x | x | x |
| | B-a-5 | 2.2 | 1.2 | 7.5 | 1.35 | 550 | x | x | x |
| | B-a-6 | 2.4 | 1.1 | 5.1 | 1.32 | 520 | x | x | x |
| | B-a-7 | 6 | 0.1 | 5.7 | 1.34 | 540 | Δ | x | x |
| | B-a-8 | 8 | 1 | 7.8 | 1.47 | 650 | Δ | x | x |
| | B-a-9 | 2 | 1 | 1.7 | 1.52 | 690 | Δ | x | x |
| | B-a-10 | film removal was found | | | | | x | x | x |
| | B-a-11 | 0.9 | 0.1 | 6.5 | 1.20 | 430 | x | x | x |
| | B-a-12 | 0.4 | 0.1 | 8.1 | 1.20 | 430 | x | x | x |

TABLE 3

| | | target area ratio | | | film composition (atomic %) | | | film thickness | | specific resistance | density | internal stress |
|---|---|---|---|---|---|---|---|---|---|---|---|---|
| | | Ru | Ta | Ir | Ru | Ta | Ir | (Å) | crystallinity | (μΩcm) | (g/cm³) | (kgf/mm²) |
| Example | B-b-1 | 13 | 62 | 25 | 21 | 40 | 39 | 2329 | A | 163 | 17.2 | −36 |
| | B-b-2 | 25 | 62 | 13 | 38 | 41 | 21 | 2300 | A | 142 | 15.6 | −28 |
| | B-b-3 | 42 | 41 | 17 | 58 | 18 | 24 | 2620 | C | 75 | 15.5 | −82 |
| | B-b-4 | 7 | 78 | 15 | 11 | 63 | 26 | 2390 | M | 110 | 17.0 | −58 |
| | B-b-5 | 7 | 41 | 52 | 11 | 22 | 67 | 2280 | C | 135 | 18.7 | −170 |
| | B-b-6 | 25 | 67 | 8 | 38 | 52 | 10 | 2220 | A | 128 | 15.6 | −30 |
| Comparative Examples | B-b-1 | 13 | 87 | | 34 | 66 | | 2180 | A | 124 | 15.0 | −43 |
| | B-b-2 | | 94 | 6 | | 94 | 6 | 2110 | C | 171 | 15.2 | −157 |
| | B-b-3 | | 46 | 54 | | 21 | 79 | 2890 | C | 121 | 19.0 | −238 |
| | B-b-4 | | 37 | 63 | | 12 | 88 | 3020 | C | 78 | 19.0 | −210 |
| | B-b-5 | | 100 | | | 100 | | 2080 | C | 181 | 14.3 | −136 |

| | | pond test | | resistance variation | SST | | BJ aptitude | | total |
|---|---|---|---|---|---|---|---|---|---|
| | | clear | black | % | M | temperature (°C.) | print quality | durability | evaluation |
| Example | B-b-1 | 21 | 7.1 | 2.6 | 1.80 | 970 | ○ | ○ | ○ |
| | B-b-2 | 13 | 6.0 | 3.1 | 1.72 | 890 | ○ | ○ | ○ |
| | B-b-3 | 15 | 6.0 | 2.9 | 1.73 | 900 | ○ | ○ | ○ |
| | B-b-4 | 8 | 4.0 | 4.4 | 1.55 | 720 | ○ | ○ | ○ |
| | B-b-5 | 12 | 7.0 | 1.4 | 1.75 | 920 | ○ | ○ | ○ |
| | B-b-6 | 18 | 6.5 | 3.2 | 1.72 | 890 | ○ | ○ | ○ |
| Comparative Examples | B-b-1 | 4 | 2.8 | 6.6 | 1.40 | 590 | x | x | x |
| | B-b-2 | 6 | 0.1 | 5.7 | 1.34 | 540 | Δ | x | x |
| | B-b-3 | 2 | 1 | 1.7 | 1.52 | 690 | Δ | x | x |
| | B-b-4 | film removal was found | | | | | x | x | x |
| | B-b-5 | 0.4 | 0.1 | 8.1 | 1.20 | 430 | x | x | x |

—: impossible to measure

TABLE 4

| | | target area ratio | | | film composition (atomic %) | | | film thickness | | specific resistance | density | internal stress |
|---|---|---|---|---|---|---|---|---|---|---|---|---|
| | | Ta | Os | Ir | Ta | Os | Ir | (Å) | crystallinity | (μΩcm) | (g/cm³) | (kgf/mm²) |
| Example | B-c-1 | 58 | 26 | 16 | 25 | 58 | 17 | 2222 | C | 122 | 18.1 | — |
| | B-c-2 | 68 | 16 | 16 | 41 | 40 | 19 | 2288 | A | 171 | 16.4 | −29 |
| | B-c-3 | 82 | 4 | 14 | 60 | 5 | 35 | 2150 | C | 155 | 15.2 | −40 |
| | B-c-4 | 57 | 10 | 33 | 23 | 25 | 52 | 2311 | C | 127 | 17.9 | −43 |
| | B-c-5 | 50 | 6 | 44 | 19 | 8 | 73 | 2710 | C | 133 | 18.8 | −60 |
| Comparative Example | B-c-1 | 42 | 26 | 32 | 14 | 50 | 36 | 2402 | C | 93 | 18.9 | — |
| | B-c-2 | 74 | 26 | | 40 | 60 | | 1998 | A | 147 | 17.2 | −35 |
| | B-c-3 | 83 | 17 | | 60 | 40 | | 2143 | A | 151 | 15.8 | −50 |
| | B-c-4 | 88 | 12 | | 67 | 33 | | 2185 | A | 153 | 14.9 | −37 |
| | B-c-5 | 94 | | 6 | 94 | | 6 | 2110 | C | 171 | 15.2 | −157 |
| | B-c-6 | 86 | | 14 | 67 | | 33 | 2320 | A | 198 | 16.8 | −58 |
| | B-c-7 | 46 | | 54 | 21 | | 79 | 2890 | C | 121 | 19.0 | −238 |
| | B-c-8 | 37 | | 63 | 12 | | 88 | 3020 | C | 78 | 19.0 | −210 |
| | B-c-9 | 100 | | | 100 | | | 2080 | C | 181 | 14.3 | −136 |

| | | pond test | | resistance variation | SST | | BJ aptitude | | total |
|---|---|---|---|---|---|---|---|---|---|
| | | clear | black | % | M | temperature (°C.) | print quality | durability | evaluation |
| Example | B-c-1 | 40 | 8.0 | 1.0 | 1.74 | 910 | ○ | ○ | ○ |
| | B-c-2 | 13 | 4.0 | 3.2 | 1.56 | 730 | ○ | ○ | ○ |
| | B-c-3 | 15 | 7.0 | 4.4 | 1.55 | 720 | ○ | ○ | ○ |
| | B-c-4 | 17 | 8.0 | 2.5 | 1.64 | 905 | ○ | ○ | ○ |
| | B-c-5 | 15 | 6.0 | 1.8 | 1.75 | 920 | ○ | ○ | ○ |
| Comparative Example | B-c-1 | 1.0 | 1.5 | 1.2 | 1.34 | 540 | x | x | x |
| | B-c-2 | 4.0 | 0.1 | 39.4 | 1.47 | 650 | x | x | x |
| | B-c-3 | 4.0 | 0.0 | 15.3 | 1.40 | 590 | x | x | x |
| | B-c-4 | 3.0 | 0.0 | — | 1.42 | 600 | x | x | x |
| | B-c-5 | 6 | 0.1 | 5.7 | 1.34 | 540 | Δ | x | x |

TABLE 4-continued

| | | | | | | | | | |
|---|---|---|---|---|---|---|---|---|---|
| | B-c-6 | 8 | 1 | 7.8 | 1.47 | 650 | Δ | x | x |
| | B-c-7 | 2 | 1 | 1.7 | 1.52 | 690 | Δ | x | x |
| | B-c-8 | film removal was found | | | | | x | x | x |
| | B-c-9 | 0.4 | 0.1 | 8.1 | 1.20 | 430 | x | x | x |

—: impossible to measure

TABLE 5

| | | target area ratio | | | film composition (atomic %) | | | film thickness | | specific resistance | density | internal stress |
|---|---|---|---|---|---|---|---|---|---|---|---|---|
| | | Ta | Re | Ir | Ta | Re | Ir | (Å) | crystallinity | (μΩcm) | (g/cm³) | (kgf/mm²) |
| Example | B-d-1 | 49 | 24 | 27 | 25 | 36 | 39 | 2520 | C | 118 | 18.2 | −164 |
| | B-d-2 | 47 | 13 | 40 | 23 | 19 | 58 | 2765 | C | 131 | 17.7 | — |
| | B-d-3 | 37 | 31 | 32 | 22 | 31 | 47 | 2440 | C | 101 | 19.5 | — |
| | B-d-4 | 54 | 12 | 34 | 37 | 13 | 50 | 2460 | C | 121 | 18.0 | −168 |
| | B-d-5 | 64 | 8 | 28 | 51 | 9 | 40 | 2490 | C | 135 | 17.0 | −178 |
| Comparative Example | B-d-1 | 27 | 37 | 36 | 9 | 51 | 40 | | C | | | — |
| | B-d-2 | 58 | 21 | 21 | 33 | 36 | 31 | 2480 | A | 139 | 17.3 | −70 |
| | B-d-3 | 49 | 39 | 12 | 22 | 52 | 26 | 2080 | A | 131 | 18.3 | −123 |
| | B-d-4 | 60 | 40 | | 57 | 43 | | 2540 | A | 133 | 17.1 | −119 |
| | B-d-5 | 94 | | 6 | 94 | | 6 | 2110 | C | 171 | 15.2 | −157 |
| | B-d-6 | 86 | | 14 | 67 | | 33 | 2320 | A | 198 | 16.8 | −58 |
| | B-d-7 | 46 | | 54 | 21 | | 79 | 2890 | C | 121 | 19.0 | −238 |
| | B-d-8 | 37 | | 63 | 12 | | 88 | 3020 | C | 78 | 19.0 | −210 |
| | B-d-9 | 100 | | | 100 | | | 2080 | C | 181 | 14.3 | −136 |

| | | pond test | | resistance variation | SST | | BJ aptitude | | |
|---|---|---|---|---|---|---|---|---|---|
| | | clear | black | % | M | temperature (°C.) | print quality | durability | total evaluation |
| Example | B-d-1 | 35 | 10.0 | 3.2 | 1.80 | 970 | ○ | ○ | ○ |
| | B-d-2 | 19 | 3.0 | 3.2 | 1.55 | 720 | ○ | ○ | ○ |
| | B-d-3 | 15 | 4.0 | 3.2 | 1.77 | 940 | ○ | ○ | ○ |
| | B-d-4 | 13 | 4.5 | 3.0 | 1.63 | 800 | ○ | ○ | ○ |
| | B-d-5 | 12 | 5.0 | 2.8 | 1.59 | 760 | ○ | ○ | ○ |
| Comparative Example | B-d-1 | — | — | — | — | — | x | x | x |
| | B-d-2 | 2 | 1.0 | 1.8 | 1.40 | 590 | x | x | x |
| | B-d-3 | — | — | — | — | — | x | x | x |
| | B-d-4 | 0.0 | 0.0 | — | 1.20 | 430 | x | x | x |
| | B-d-5 | 6 | 0.1 | 5.7 | 1.34 | 540 | Δ | x | x |
| | B-d-6 | 8 | 1 | 7.8 | 1.47 | 650 | Δ | x | x |
| | B-d-7 | 2 | 1 | 1.7 | 1.52 | 690 | Δ | x | x |
| | B-d-8 | film removal was found | | | | | x | x | x |
| | B-d-9 | 0.4 | 0.1 | 8.1 | 1.20 | 430 | x | x | x |

—: impossible to measure

TABLE 6

| | | target area ratio | | | film composition (atomic %) | | | film thickness | | specific resistance | density | internal stress |
|---|---|---|---|---|---|---|---|---|---|---|---|---|
| | | Al | Y | Ir | Al | Y | Ir | (Å) | crystallinity | (μΩcm) | (g/cm³) | (kgf/mm²) |
| Example | C-1 | 25 | 10 | 65 | 13 | 2 | 85 | 2624 | C | 56 | 20.8 | −150 |
| | C-2 | 20 | 28 | 52 | 16 | 18 | 66 | 2660 | M | 162 | 16.2 | −165 |
| | C-3 | 27 | 17 | 56 | 21 | 9 | 70 | 2710 | M | 158 | 17.5 | −172 |
| | C-4 | 37 | 20 | 43 | 29 | 16 | 55 | 2805 | M | 179 | 12.8 | −271 |
| | C-5 | 25 | 34 | 42 | 30 | 16 | 54 | 2875 | A | 155 | 14.9 | −8 |
| Comparative Example | C-1 | 35 | 39 | 26 | 49 | 15 | 36 | — | A | — | — | — |
| | C-2 | 42 | 29 | 29 | 51 | 8 | 41 | — | A | — | — | — |
| | C-3 | 18 | 22 | 50 | 12 | 24 | 64 | 3560 | A | 173 | 12.6 | −9 |
| | C-4 | 24 | 36 | 40 | 31 | 24 | 45 | — | A | — | — | — |
| | C-5 | 37 | | 63 | 8 | | 92 | 3089 | C | 57 | 17.4 | −215 |
| | C-6 | 56 | | 44 | 41 | | 59 | 3222 | C | 216 | 12.6 | −167 |
| | C-7 | 85 | | 16 | 80 | | 20 | 4120 | A | 503 | — | −22 |
| | C-8 | 72 | | 28 | 58 | | 42 | 3580 | M | 351 | — | −94 |
| | C-9 | 68 | | 32 | 51 | | 49 | 3350 | C | 240 | — | −157 |
| | C-10 | 18 | | 82 | 3 | | 97 | film removal was found | | | | |

TABLE 6-continued

| | | pond test | | resistance variation | SST | | BJ aptitude | | total |
|---|---|---|---|---|---|---|---|---|---|
| | | clear | black | % | M | temperature (°C.) | print quality | durability | evaluation |
| Example | C-1 | 30 | 11 | 0.1 | 1.60 | 720 | o | o | o |
| | C-2 | 9 | 6 | 0.3 | 1.60 | 720 | o | o | o |
| | C-3 | 12 | 8 | 0.2 | 1.59 | 710 | o | o | o |
| | C-4 | 10 | 7.5 | 0.3 | 1.56 | 730 | o | o | o |
| | C-5 | 5 | 4.5 | 0.1 | 1.58 | 570 | o | o | o |
| Comparative Example | C-1 | — | — | — | — | — | x | x | x |
| | C-2 | — | — | — | — | — | x | x | x |
| | C-3 | 0.0 | 0.0 | — | 1.34 | 540 | x | x | x |
| | C-4 | — | — | — | — | — | x | x | x |
| | C-5 | 10 | 8 | 2.0 | 1.80 | 970 | o | o | x |
| | C-6 | 10 | 6 | 3.9 | 1.74 | 910 | o | o | x |
| | C-7 | 0.0 | 0.0 | — | — | — | x | x | x |
| | C-8 | 5 | 0.2 | 5.1 | 1.42 | 600 | Δ | x | x |
| | C-9 | 0.0 | 0.0 | — | — | — | x | x | x |
| | C-10 | film removal was found | | | | | | | |

—: impossible to measure

TABLE 7

| | | target area ratio | | | film composition (atomic %) | | | film thickness | | specific resistance | density | internal stress |
|---|---|---|---|---|---|---|---|---|---|---|---|---|
| | | Cr | Ru | Ir | Cr | Ru | Ir | (Å) | crystallinity | (μΩcm) | (g/cm³) | (kgf/mm²) |
| Example | D-1 | 31 | 35 | 35 | 7 | 42 | 51 | 2949 | C | 34 | 17.0 | −238 |
| | D-2 | 53 | 16 | 31 | 22 | 23 | 45 | 2837 | C | 46 | 14.7 | −136 |
| | D-3 | 62 | 13 | 25 | 46 | 17 | 37 | 2861 | C | 65 | 12.5 | −37 |
| | D-4 | 60 | 23 | 17 | 34 | 37 | 29 | 2791 | C | 55 | 11.8 | −25 |
| | D-5 | 62 | 25 | 13 | 13 | 33 | 21 | 2765 | C | 53 | 11.5 | −19 |
| Comparative Example | D-1 | 87 | 13 | | 75 | 25 | | 2736 | M | 54 | 8.4 | −88 |
| | D-2 | 44 | | 55 | 19 | | 81 | 3278 | C | 55 | 17.2 | — |
| | D-3 | 100 | | | 100 | | | 3900 | C | 50 | 5.2 | +300 |

| | | pond test | | resistance variation | SST | | BJ aptitude | | total |
|---|---|---|---|---|---|---|---|---|---|
| | | clear | black | % | M | temperature (°C.) | print quality | durability | evaluation |
| Example | D-1 | 7 | 4.5 | 1.9 | 1.9 | 720 | o | o | o |
| | D-2 | 12 | 5.2 | 1.3 | 1.3 | 810 | o | o | o |
| | D-3 | 19 | 7.7 | 0.9 | 0.9 | 940 | o | o | o |
| | D-4 | 13 | 6.1 | 1.0 | 1.0 | 830 | o | o | o |
| | D-5 | 8 | 5.5 | 1.1 | 1.1 | 720 | o | o | o |
| Comparative Example | D-1 | 4 | 2.0 | 5.2 | 1.45 | 630 | Δ | x | x |
| | D-2 | 5 | 2.5 | 0.4 | 1.50 | 680 | Δ | x | x |
| | D-3 | 0.0 | 0.0 | — | 1.10 | 360 | x | x | x |

—: impossible to measure

TABLE 8

| | | target area ratio | | film composition (atomic %) | | film thickness | | specific resistance | density | internal stress |
|---|---|---|---|---|---|---|---|---|---|---|
| | | Ta | Pt | Ta | Pt | (Å) | crystallinity | (μΩcm) | (g/cm³) | (kgf/mm²) |
| Example | E-1 | 28 | 72 | 25 | 75 | 1695 | C | 153 | 19.2 | −160 |
| | E-2 | 32 | 68 | 31 | 69 | 1655 | C | 154 | 18.8 | −152 |
| | E-3 | 37 | 63 | 38 | 62 | 1635 | C | 155 | 18.5 | −144 |
| Comparative Example | E-1 | 57 | 43 | 56 | 44 | 1790 | A | 168 | 16.7 | −30 |
| | E-2 | 80 | 20 | 76 | 24 | 2063 | C | 147 | 15.7 | −64 |
| | E-3 | 94 | 6 | 92 | 8 | 2205 | C | 148 | 14.7 | −125 |

TABLE 8-continued

| | | | | | | | | | |
|---|---|---|---|---|---|---|---|---|---|
| E-4 | 100 | 100 | 2680 | C | 58 | — | — | | |
| E-5 | 100 | 100 | 2080 | C | 181 | 14.3 | −136 | | |

| | | pond test | | resistance variation | SST | | BJ aptitude | | total |
|---|---|---|---|---|---|---|---|---|---|
| | | clear | black | % | M | temperature (°C.) | print quality | durability | evaluation |
| Example | E-1 | 15 | 4 | 2.2 | 1.55 | 720 | o | o | o |
| | E-2 | 14 | 5 | 2.0 | 1.57 | 740 | o | o | o |
| | E-3 | 13 | 6 | 1.8 | 1.60 | 770 | o | o | o |
| Comparative Example | E-1 | 7 | 3 | 5.0 | 1.45 | 630 | Δ | x | x |
| | E-2 | 7 | 3 | 6.2 | 1.40 | 590 | Δ | x | x |
| | E-3 | 7 | 0.3 | 5.2 | 1.35 | 550 | Δ | x | x |
| | E-4 | 0.0 | 0.0 | — | 1.20 | 430 | x | x | x |
| | E-5 | 0.4 | 0.1 | 8.1 | 1.20 | 430 | x | x | x |

—: impossible to measure

We claim:

1. A substrate for an ink jet head which includes an electrothermal converting body provided with a heat generating resistor for generating, upon energization, heat energy that is directly applied to an ink on a heat acting face, causing discharge of the ink, characterized in that said heat generating resistor is formed from a material consisting essentially of Ir and Cr in the following respective composition amounts:

24 atomic %≦Ir≦68 atomic %, and 32 atomic %≦Cr≦76 atomic %.

2. A substrate for ink jet head according to claim 1, wherein the material of which the heat generating resistor is composed is a non-single crystalline material.

3. A substrate for ink jet head according to claim 2, wherein the non-single crystalline material is a polycrystalline material.

4. A substrate for ink jet head according to claim 1, wherein the material of which the heat generating resistor is composed contains, as an impurity or impurities, at least one element selected from the group consisting of Ar, O, C, N, Si, B, Na, Cl and Fe.

5. A substrate for ink jet head according to claim 1, wherein the electrothermal converting body comprises a pair of electrodes disposed on the heat generating resistor wherein said pair of electrodes are held in contact with the heat generating resistor to effect the energization.

6. A substrate for ink jet head according to claim 1, wherein the electrothermal converting body has comprises a pair of electrodes disposed under the heat generating resistor wherein said pair of electrodes are held in contact with the heat generating resistor to effect the energization.

7. A substrate for ink jet head according to claim 1, wherein the heat acting face is formed by the heat generating resistor.

8. A substrate for ink jet head according to claim 1, wherein the heat acting face is formed by a protective layer disposed on the heat generating resistor.

9. A substrate for ink jet head according to claim 8, wherein the protective layer comprises a Ta layer forming the heat acting face and a Si-containing insulating layer interposed between the Ta layer and the heat generating resistor.

10. A substrate for ink jet head according to claim 1, wherein the heat generating resistor has a thickness in the range of from 300 Å to 1 μm.

11. A substrate for ink jet head according to claim 10, wherein the heat generating resistor has a thickness in the range of from 1000 Å to 5000 Å.

12. An ink jet head which includes an electrothermal converting body disposed along an ink pathway, said electrothermal converting body comprising a heat generating resistor for generating, upon energization, heat energy that is directly applied to an ink on a heat acting face, causing discharge of the ink, characterized in that said heat generating resistor is formed from a material consisting essentially of Ir and Cr in the following respective composition amounts:

24 atomic %≦Ir≦68 atomic %, and 32 atomic %≦Cr≦76 atomic %.

13. An ink jet head according to claim 12, wherein the material of which the heat generating resistor is composed is a non-single crystalline material.

14. An ink jet head according to claim 13, wherein the non-single crystalline material is a polycrystalline material.

15. An ink jet head according to claim 12, wherein the material of which the heat generating resistor is composed contains, as an impurity or impurities, at least one element selected from the group consisting of Ar, O, C, N, Si, B, Na, Cl and Fe.

16. An ink jet head according to claim 12, wherein the electrothermal converting body comprises a pair of electrodes disposed on the heat generating resistor wherein said pair of electrodes are held in contact with the heat generating resistor to effect the energization.

17. An ink jet head according to claim 12, wherein the electrothermal converting body comprises a pair of electrodes disposed under the heat generating resistor wherein said pair of electrodes are held in contact with the heat generating resistor to effect the energization.

18. A ink jet head according to claim 12, wherein the heat acting face is formed by the heat generating resistor.

19. An ink jet head according to claim 12, wherein the heat acting face is formed by a protective layer disposed on the heat generating resistor.

20. An ink jet head according to claim 19, wherein the protective layer comprises a Ta layer forming the heat acting face and a Si-containing insulating layer interposed between the Ta layer and the heat generating resistor.

21. An ink jet head according to claim 12, wherein the heat generating resistor has a thickness in the range of from 300 Å to 1 μm.

22. An ink jet head according to claim 12, wherein the heat generating resistor has a thickness in the range of from 1000 Å to 5000 Å.

23. An ink jet head according to claim 12, wherein the ink is discharged in a direction which is substantially the same as a direction in which the ink is supplied to the heat acting fact.

24. An ink jet head according to claim 12, wherein the ink is discharged in a direction which is substantially perpendicular to a direction in which the ink is supplied to the heat acting fact.

25. An ink jet head according to claim 12, further comprising a plurality of discharging outlets for discharging the ink therethrough and which are arranged so as to correspond to a width of a recording area of a record medium on which recording is to be performed.

26. An ink jet head according to claim 25, wherein at least 1000 of the discharging outlets are arranged.

27. An ink jet head according to claim 26, wherein at least 2000 of the discharging outlets are arranged.

28. An ink jet head according to claim 12, further comprising a functional element for participating in discharging the ink is disposed structurally inside of a surface of the ink jet head structure.

29. An ink jet head according to claim 12, in which said head is of cartridge type which integrally comprises an ink tank for storing therein the ink to be supplied to the heat acting face.

30. An ink jet apparatus which includes an electrothermal converting body provided with a heat generating resistor for generating, upon energization, heat energy that is directly applied to an ink on a heat acting face, causing discharge of the ink, and means for supplying a signal to said electrothermal converting body, characterized in that said heat generating resistor is formed from a material consisting essentially of Ir and Cr in the following respective composition amounts:

24 atomic %$\leqq$Ir$\leqq$68 atomic %, and 32 atomic %$\leqq$Cr$\leqq$76 atomic %.

31. An ink jet apparatus according to claim 30 wherein said apparatus effects color recording.

32. An ink jet apparatus according to claim 30, wherein the means for supplying a signal to the electrothermal converting body comprises a control circuit for controlling the ink jet apparatus.

33. An ink jet apparatus according to claim 30, further comprises a carriage for holding thereon a head having the electrothermal converting body.

* * * * *

UNITED STATES PATENT AND TRADEMARK OFFICE

CERTIFICATE OF CORRECTION

PATENT NO. : 5,477,252

DATED : December 19, 1995

INVENTORS : KENJI HASEGAWA, ET AL.

It is certified that error appears in the above-identified patent and that said Letters Patent is hereby corrected as shown below:

ON TITLE PAGE

In [56] References Cited, under FOREIGN PATENT DOCUMENTS: "135163 8/1984 Japan...B41J 3/04" should be deleted.

COLUMN 2

Line 65, "an" should read --a--.

COLUMN 3

Line 4, "expose" should read --exposure--.
Line 60, "obtain" should read --obtained--.

COLUMN 4

Line 11, "a" should read --an--.
Line 13, "a" should read --an--.
Line 15, "let" should read --jet--.
Line 61, "Other" should read --Another--.

UNITED STATES PATENT AND TRADEMARK OFFICE

CERTIFICATE OF CORRECTION

PATENT NO. : 5,477,252

DATED : December 19, 1995

INVENTORS : KENJI HASEGAWA, ET AL.

It is certified that error appears in the above-identified patent and that said Letters Patent is hereby corrected as shown below:

COLUMN 5

Line 35, "other" should read --another--.
Line 43, "other" should read --another--.

COLUMN 6

Figure 4B:
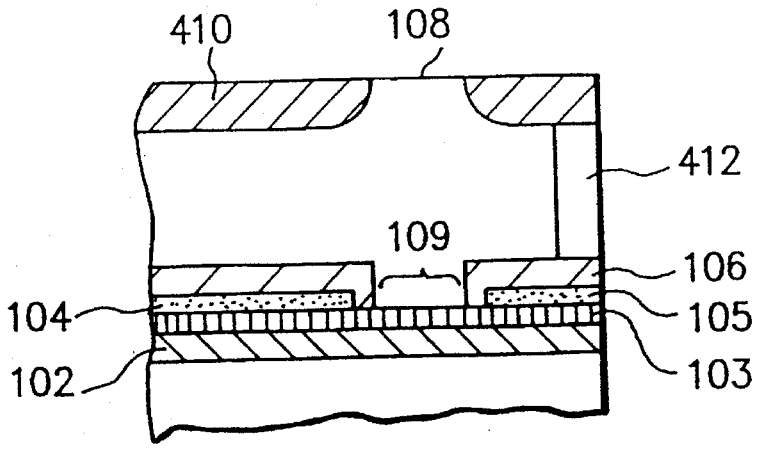

Line 1, "PIG. 4(b)" should read --FIG. 4(b)--.

COLUMN 9

Line 64, "matters" should read --matter--.
Line 67, "interfere" should read --interfere with--.

COLUMN 17

Line 12, "Jet" should read --jet--.
Line 41, "Jet" should read --jet--.

COLUMN 18

Line 31, "With" should read --with--.

COLUMN 19

Line 11, "transmit" should read --transmits--.

UNITED STATES PATENT AND TRADEMARK OFFICE

CERTIFICATE OF CORRECTION

PATENT NO. : 5,477,252

DATED : December 19, 1995

INVENTORS : KENJI HASEGAWA, ET AL.

It is certified that error appears in the above-identified patent and that said Letters Patent is hereby corrected as shown below:

COLUMN 20

Line 32, "those," should read --those--.

COLUMN 21

Line 23, "entire" should read --entirety--.
Line 32, "entire" should read --entirety--.
Line 65, "resulting" should read --resulting in--.
Line 66, "let should read --jet--.

COLUMN 22

Line 20, "a ink" should read --an ink--.

COLUMN 23

Line 24, "raw" should read --row--.
Line 31, "whereby" should read --thereby--.

COLUMN 24

Line 37, "A" should read --An--.

COLUMN 25

Line 62, "discgarging" should read --discharging--.

UNITED STATES PATENT AND TRADEMARK OFFICE

CERTIFICATE OF CORRECTION

PATENT NO. : 5,477,252

DATED : December 19, 1995

INVENTORS : KENJI HASEGAWA, ET AL.

It is certified that error appears in the above-identified patent and that said Letters Patent is hereby corrected as shown below:

COLUMN 26

Line 11, "head" should read --heads--.
Line 22, "$6x10^7$;" should read --$\geqq 6x10^7$;--.
Line 24, "5%;" should read --$\leqq$5%;--.

COLUMN 28

Line 10, "raw" should read --row--.
Line 17, "whereby" should read --thereby--.
Line 31, "Jet" should read --jet--.

COLUMN 29

Line 48, "On" should read --on--.
Line 51, "Jet" should read --jet--.

COLUMN 30

Line 60, "raw" should read --row--.

COLUMN 32

Line 7, "Jet" should read --jet--.

UNITED STATES PATENT AND TRADEMARK OFFICE

CERTIFICATE OF CORRECTION

PATENT NO. : 5,477,252

DATED : December 19, 1995

INVENTORS : KENJI HASEGAWA, ET AL.

It is certified that error appears in the above-identified patent and that said Letters Patent is hereby corrected as shown below:

COLUMN 33

Line 16, "raw" should read --row--.
Line 23, "whereby" should read thereby--.
Line 43, "responsibility," should read --responsivity,--.

COLUMN 35

Line 45, "raw" should read --row--.

COLUMN 38

Line 4, "raw" should read --row--.
Line 12, "whereby" should read --thereby--.

COLUMN 39

Line 49, "an CR" should read --a Cr--.
Line 52, "CR" should read --Cr--.
Line 53, "CR" should read --Cr--.

COLUMN 40

Line 16, "raw" should read --row--.
Line 24, "whereby" should read --thereby--.
Line 30, "raw" should read --row--.

COLUMN 55

Line 48, "has" should be deleted.

UNITED STATES PATENT AND TRADEMARK OFFICE

CERTIFICATE OF CORRECTION

PATENT NO. : 5,477,252

DATED : December 19, 1995

INVENTORS : KENJI HASEGAWA, ET AL.

It is certified that error appears in the above-identified patent and that said Letters Patent is hereby corrected as shown below:

COLUMN 56

"A ink" should read --An ink--.

COLUMN 57

Line 4, "fact." should read --face.--.
Line 8, "fact." should read --face.--.
Line 23, "cartridge" should read --a cartridge--.

COLUMN 58

Line 21, "comprises" should read --comprising--.

Signed and Sealed this

Fifteenth Day of October, 1996

*Attest:*

Bruce Lehman

BRUCE LEHMAN

*Attesting Officer*

*Commissioner of Patents and Trademarks*